US006486847B1

(12) United States Patent
Yamamoto et al.

(10) Patent No.: US 6,486,847 B1
(45) Date of Patent: Nov. 26, 2002

(54) MONOPOLE ANTENNA

(75) Inventors: Atsushi Yamamoto; Toshimitsu Matsuyoshi; Koichi Ogawa, all of Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/517,515

(22) Filed: Mar. 2, 2000

(30) Foreign Application Priority Data

Mar. 2, 1999 (JP) ..... 11-054079
Feb. 17, 2000 (JP) ..... 2000-039508
Feb. 23, 2000 (JP) ..... 2000-045915

(51) Int. Cl.[7] ..... H01Q 1/42
(52) U.S. Cl. ..... 343/789; 343/846
(58) Field of Search ..... 343/700 MS, 702, 343/829, 846, 789, 752, 830; H01Q 1/42

(56) References Cited

U.S. PATENT DOCUMENTS 3,534,376 A * 10/1970 Webb ..... 343/786
3,568,206 A * 3/1971 Sisson ..... 343/750
4,147,912 A * 4/1979 Uyeda ..... 219/10.55
4,821,040 A * 4/1989 Johnson et al. ..... 343/700 MS
4,897,664 A * 1/1990 Killackey et al. ..... 343/789
5,539,418 A * 7/1996 Egashira et al. ..... 343/712
5,874,924 A * 2/1999 Csongor et al. ..... 343/797

OTHER PUBLICATIONS

Kathleen L. Virga et al., "Low–Profile Enhanced–Bandwidth PIFA Antennas for Wireless Communications Packaging", *IEEE Transactions on Microwave Theory and Techniques*, vol. 45, No. 10, Oct. 1997, pp. 1879–1888.

* cited by examiner

*Primary Examiner*—Tho Phan
(74) *Attorney, Agent, or Firm*—McDermott, Will & Emery

(57) ABSTRACT

The ground conductor, the side conductor, and the ceiling conductor surround the antenna element, which is connected to the coaxial power supply part arranged on the surface of the ground conductor. The ceiling conductor is arranged to face the ground conductor with the antenna element therebetween. The ceiling conductor is provided with an opening whose size, shape, and position are changed to vary the directivity of radio waves.

22 Claims, 32 Drawing Sheets

λ free space wavelength

Eθ
Eφ

| | MRG | PAG | FREQ | FILE |
|---|---|---|---|---|
| Eθ | 0.21 | -5.17 | 1930. | 22.d |
| Eφ | -5.20 | -10.56 | 1930. | 23.d |

| | MRG | PAG | FREQ | FILE |
|---|---|---|---|---|
| Eθ | -13.80 | -17.49 | 1930. | 27.d |
| Eφ | -11.39 | -15.56 | 1930. | 26.d |

| | MRG | PAG | FREQ | FILE |
|---|---|---|---|---|
| Eθ | 4.80 | 0.16 | 1930. | 25.d |
| Eφ | -18.39 | -20.13 | 1930. | 24.d |

MONOPOLE ANTENNA

BACKGROUND OF THE INVENTION

1. Field of the Invention

The present invention relates to a monopole antenna mainly used for mobile communication, and more specifically, to a monopole antenna suitable for base stations.

2. Description of the Related Art

Prior art antennas are shown in FIGS. 36 and 37.

A first prior art antenna shown in FIG. 36 will be described as follows. FIG. 36 shows one technique to change the directivity of the vertical plane of the antenna, and FIGS. 37(A)–37(D) show examples of radiation directivity of monopole antennas.

FIG. 36 shows a ground conductor 111, a coaxial power supply part 112, and an antenna element 113 connected to the coaxial power supply part 112 on the ground conductor 111. In this case, a monopole antenna has an axis symmetric structure where the ground conductor 111 is shaped like a disk, the coaxial power supply part 12 is located at the center of the surface of the ground conductor 111, and the antenna element 113 is connected to the coaxial power supply part 12 in a manner to be perpendicular to the ground conductor 111. The radio waves of the antenna are nondirectional with respect to the horizontal plane of the antenna.

A method of changing the directivity of the radio waves on the vertical surface in a monopole antenna is to change the size of the ground conductor 111. When the ground conductor 111 have a finite size, radio waves diffract at the edge of the ground conductor 111. The size of the diffraction depends on the size of the ground conductor 111; the larger the ground conductor 111 is, the smaller the diffraction becomes, and vice versa. The entire radio waves of the antenna are the sum of the radio waves from the antenna element 113 and the diffraction waves from the edge of the ground conductor 111. If the antenna is divided into two sides: the top side having the antenna element 113 and the bottom side below the ground conductor 111, fewer radio waves flow to the bottom side and more radio waves are applied to the top side with increasing the ground conductor 111 in size. Also, the maximum radiation direction approaches the horizontal plane of the antenna. On the other hand, as the ground conductor 111 becomes smaller, more radio waves flow to the bottom side, making the maximum radiation direction approach the upright direction of the antenna. However, when the diameter of the ground conductor 111 is equal to or below ½ wavelength, the radio waves flow equally to the top and bottom sides, exhibiting directivity in the form of the number 8 on the vertical plane of the antenna. At this moment, the maximum radiation direction is the horizontal plane of the antenna. FIGS. 37 show the radiation directivity when the ground conductor 111 has a diameter of about ½ wavelength (37A), about 0.8 wavelength (37B), and about 3wavelength (37C). In FIGS. 36 and 37, X and Y indicate the direction parallel to the surface of the ground conductor 111 and Z indicates the direction perpendicular to the ground conductor 111. The radio directivity is calibrated in 10 dB, and the unit used is dBd, referred to the gain of a dipole antenna.

Thus a monopole antenna can change the directivity of the radio waves on the vertical plane of the antenna by changing the ground conductor 111 in size.

The second prior art antenna will be described with reference to FIG. 38 showing a technique to change the directivity of an antenna. FIG. 38 illustrates a monopole antenna array provided with two antenna elements, and FIG. 39 shows an example of radiation directivity.

The antenna array comprises a ground conductor 121, coaxial power supply parts 122 and 123, antenna elements 124 and 125, power supply paths 126 and 127, and a power distribution/composition circuit 128. The antenna elements 124 and 125 are connected to the coaxial power supply parts 122 and 123, respectively, on the ground conductor 121. The coaxial power supply parts 122 and 123 are connected to the power distribution/composition circuit 128 via the power supply paths 126 and 127, respectively. The ground conductor 121 is provided on the XY plane.

The following will describe the case where there are two antenna elements 124 and 125, and radio waves are strong in the X axis direction.

The antenna elements 124 and 125 are arranged ½ wavelength apart from each other on the X axis to be symmetric with respect to the origin point, and currents to be supplied have a phase difference of 180 degrees. At this moment, the array factors become co-phase in the +X and −X directions to reinforce each other. When the antenna is symmetric with respect to the ZX plane and the ZY plane, the radio waves become symmetric with respect to the ZX plane and the ZY plane. The waves to be radiated become strong in the +X direction and the −X direction where the radiation waves from the antenna elements 124 and 125 have the same phase. Furthermore, changing the size of the ground conductor 121 or the distance between the antenna elements allows the directivity of the radio waves on the vertical plane of the antenna to change.

FIG. 39 shows as an example the radiation directivity when the antenna elements are made of a ¼ wavelength metallic wire, the antenna elements are supplied with power at a one to one ratio, and the ground conductor is a rectangle having one side of 2.75 wavelength parallel to the X axis and the other side of 2.25 wavelength parallel to the Y axis. In FIG. 39, X and Y. indicate the direction parallel to the plane of the ground conductor 121, and Z indicates the direction perpendicular to the ground conductor 121. The radio directivity is calibrated in 10 dB, and the unit is dBd, referred to the gain of a dipole antenna.

Thus, an antenna capable of changing the directivity of radio waves is achieved by arranging the antenna elements so as to form an array at an appropriate interval and by providing the antenna elements with an appropriate phase difference and an appropriate power distribution ratio.

However, the first prior art antenna has the following drawback; intensifying the radiation in the horizontal direction of the antenna requires a two-dimensionally large ground conductor 111, which is against miniaturization of the monopole antenna. A monopole antenna is not allowed to occupy so large an area on the ceiling, which is one of the best sites indoors for a monopole antenna. Hence the first prior art antenna, which must be large in size because of its being difficult to be small two dimensionally, is unsuitable.

On the other hand, the second prior art antenna can intensify radio waves by providing directivity in the horizontal direction of the antenna. However, it requires to have the power supply paths 126 and 127 and the power distribution/composition circuit 128, which causes a intrinsic loss in these components 126, 127, and 128 due to the structure of the circuit. Another loss is caused when the waves radiated from one antenna element 124 (125) are undesirably received by the other antenna element 125 (124) due to poor isolation between the antenna elements. These losses deteriorate the radiation efficiency. The latter-mentioned loss in particular leads to a reflection loss as the entire antenna array, and the reflected signal may reversely flow to each device connected to the antenna, thereby badly affecting the characteristics of each device. In order to secure excellent antenna characteristics, the former-mentioned loss should be reduced in the power supply paths and the power distribution/composition circuit 128, and the latter case requires to establish good isolation between the antenna elements. In the former case, components having a fewer loss can be employed as the power supply paths 126 and 127 and the power distribution/composition circuit 128. The latter case needs to extend the distance between the antenna elements. Hence, the antenna array in the second prior art is unsuitable for miniaturization of an antenna. When there are more than two antenna elements, the distance between them is considered to become larger than in the second prior art antenna which have two antenna elements. The large-scale antenna array is unsuitable for miniaturization of an antenna. A monopole antenna is not allowed to occupy so large an area on the ceiling, which is one of the best sites indoors for a monopole antenna. Hence the second prior art antenna, which must be large in size because of its being difficult to be small two dimensionally, is also unsuitable.

When an antenna is installed on a ceiling, in order to enhance the efficiency of wave radiation, it is preferable to hang the antenna elements upside down from the ceiling so as to make them face the space into which radio waves are radiated. It is further preferred that there is nothing to disturb the propagation of the radio waves between the antenna and the entire radiation space, and that the space including the entire radiation objects can be seen from the antenna elements. It is further desired to install a monopole antenna inconspicuously not to be an eyesore; however, in the prior art antennas shown in FIGS. 36 through 39 the antenna elements project from the ceiling unsightly, and the first and second prior art antennas cannot satisfy the demand due to their failure to be miniaturized.

SUMMARY OF THE INVENTION

In view of the above problems, the main object of the present invention is to provide an antenna, which is small in size, particularly its top side, and capable of changing the directivity of radio wave.

In order to achieve the object, the present invention comprises a ground conductor; a power supply part arranged on a surface of said ground conductor; an antenna element connected to said power supply part; and a side conductor surrounding a space including said antenna element apart from said antenna element. Consequently, the wave radiation along the horizontal plane of the antenna can be intensified without increasing the two-dimensional size very much. The reason for this is as follows. The side conductor functions as the periphery of the ground conductor to prevent wave diffraction effectively, thereby intensify wave radiation in the horizontal direction of the antenna. Furthermore, the side conductor is arranged above the ground conductor, which hardly increases the two-dimensional size of the antenna.

It is preferred that the antenna is further provided with a ceiling conductor facing said ground conductor with said antenna element therebetween because this structure can reduce the size of the antenna in the vertical direction. Since the ceiling conductor functions as the tip of the antenna element, the antenna element can be reduced in length by that. The antenna is reduced in size in the vertical direction accordingly.

It is preferred that the edge portion of said ceiling conductor is electrically connected to said side conductor, because this structure allows the directivity of the radio waves along the horizontal plane to be adjusted as desired. The reason for this is as follows. When the edge portion of the ceiling conductor is connected to the side conductor, current leaks form there towards the ground conductor. As a result, radio waves are hardly radiated in the direction extending outside from the ceiling conductor along the connection point. Setting the direction along which the connection point of the ceiling conductor and the side conductor is provided can set the directivity of the waves along the horizontal plane.

It is preferred that said ceiling conductor has a circular central portion because this allows the directivity of the waves along the horizontal plane to be adjusted more freely. The reason for this is as follows. When the edge of the ceiling conductor is connected to the side conductor, the minimum point of the waves is formed in the direction extending outside along the connection point, which enables the adjustment of the directivity. However, there are cases where the radiation level is lower than desired at the minimum point. In contrast, the circular center of the ceiling conductor allows waves to be radiated from the entire circumference of the circular portion, making the wave radiation approximately nondirectional on the horizontal plane. As a result, the radiation of waves becomes a mixture of the radiation from the circular portion and the radiation from the remaining portion, thereby compensating the minimum point of the waves. The amount of radiation of waves from the circular portion can be adjusted by changing the size of the circular portion.

It is preferred that said side conductor is electrically connected to said ground conductor, because it can achieve the matching of input impedances. The reason for this is as follows. When the antenna is reduced in size in the vertical direction by providing the ceiling conductor, the ceiling conductor and the ground conductor are arranged close to each other, which causes capacitive component between them, leading to mismatching of the input impedances. In contrast, electrically connecting the ceiling conductor to the ground conductor via the side conductor causes a continuity loop between these conductors, which develops an inductance. Consequently, the inductance compensates the capacitive component, thereby solving the mismatching of the impedances.

It is preferred that at least one of said ground conductor, said side conductor, and said ceiling conductor has an opening because the set wave directivity can be set as desired by adjusting the position, size, and other conditions of the opening when it is formed.

It is preferred that the antenna is provided with means for adjusting the size of said opening. Adjusting the size of the opening allows the directivity and impedances to be fine adjusted after the formation of the opening.

It is preferred that said power supply part is arranged on the origin point, said ground conductor is arranged on the XY plane, said ground conductor and said side conductor are designed to be symmetric with respect to the ZY plane, and said opening is arranged to be symmetric with respect to the ZY plane. This structure allows the directivity of waves to be symmetric with respect to the ZY plane.

It is preferred that said ground conductor and said side conductor are designed to be symmetric with respect to the ZX plane, and said opening is arranged to be symmetric with respect to the ZX plane. This structure allows the directivity of waves to be symmetric with respect to the ZX plane.

It is preferred that said antenna element is electrically connected to said ceiling conductor. This stabilizes not only the structure of the antenna but also the impedance of the antenna, thereby improving the characteristics of the antenna.

It is preferred that the antenna is provided with a dielectric member having permittivity higher than air in a space surrounded by said ground conductor and said side conductor. This makes the antenna compact and low-profile.

It is preferred that said space is filled with said dielectric member. This makes the antenna compact and low-profile. In addition, there is no clearance inside the antenna that brings dust inside the space or causes condensation, thereby improving the reliability.

It is preferred that said dielectric member is structured as a lid for the space surrounded by said side conductor, and either,said ground conductor or said ceiling conductor is provided on said dielectric member. This develops no clearance inside the antenna that brings dust inside or causes condensation, thereby improving the reliability. Furthermore, the space inside the antenna can be easily sealed by using the dielectric member as a lid.

It is preferred that said side conductor is made of a via hole formed in said dielectric member. This facilitates the formation of the side conductor because the via hole can be formed comparatively easily by a general substrate production method.

It is preferred that the antenna is provided with at least one matching element arranged apart from said antenna element, said matching element being electrically connected to said ground conductor. This changes the impedance of the antenna to establish good matching conditions.

It is preferred that at least one said matching element is electrically connected to said antenna element. This increases the input impedance of the monopole antenna.

It is preferred that at least one said matching element is electrically connected to said ceiling conductor. This changes the input impedance of the monopole antenna.

It is preferred that a radio device comprising: a monopole antenna of the present invention; amplification means for amplifying transmission signals supplied to said monopole antenna and reception signals supplied from said monopole antenna; frequency selection means for selecting frequencies of the transmission signals and reception signals; and a cabinet for storing said monopole antenna and said amplification means, and is also preferred that said cabinet is provided with a concave portion on a surface thereof for storing said monopole antenna inside. Consequently, a radio device far from being an eyesore can be achieved while maintaining or improving the compact and low-profile characteristics. This is because the monopole antenna is stored in the concave portion on the cabinet surface, making the antenna hard to be seen from outside. Since the compact and low-profile characteristics of the antenna are improved, incorporating the antenna inside the device does. not disturb the compact and low-profile characteristics of the radio device.

It is preferred that an arrangement structure of a monopole antenna comprises a plurality of monopole antennas of the present invention arranged in a manner to conform the direction for minimizing the directivity of the horizontal plane of each of said monopole antennas. As a result, the wave transmission of adjacent monopole antennas has minimum influence to each other, thereby establishing excellent isolation between them.

BRIEF DESCRIPTION OF THE DRAWINGS

These and other objects of the invention will become apparent from the following description and be clarified in the accompanying claims. Executing the present invention will remind those skilled in the art various changes not mentioned in the present specification.

DETAILED DESCRIPTION OF THE INVENTION

The preferred embodiments of the present invention will be,described with reference to the drawings.

(Embodiment 1)

Figure 1A:
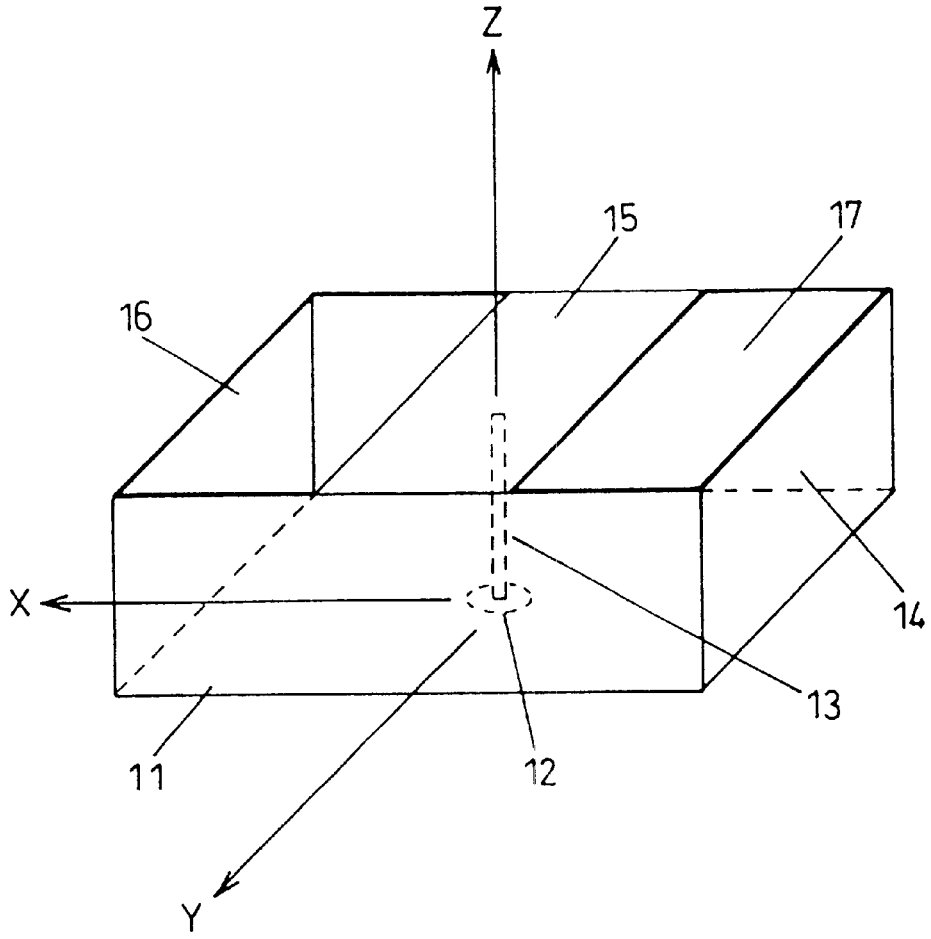
FIG. 1A is a rough perspective view showing a first preferred embodiment of the present invention.
Figure 1B:
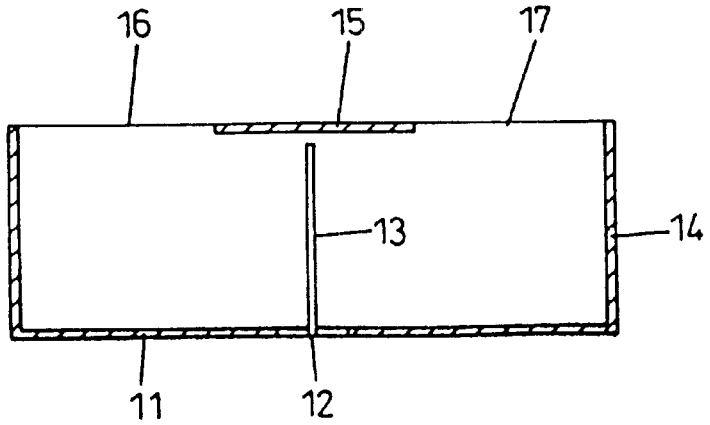
FIG. 1B is a cross sectional view of FIG. 1A.

The monopole antenna of the first embodiment of the present invention is shown in FIGS. 1A and 1B. FIG. 1A shows the rough perspective view of the monopole antenna and FIG. 1B shows its sectional view. FIGS. 1A and 1B illustrate a ground conductor 11, a coaxial power supply part 12 as an example of power supply part, an antenna element 13, a side conductor 14, a ceiling conductor 15, and openings 16 and 17.

The monopole antenna having these components has the following structure. The ground conductor 11 is arranged on the XY plane. The ground conductor 11, the side conductor 14, and the ceiling conductor 15 are electrically connected to each other so as to constitute a cuboid symmetric with respect to both the ZY plane and the ZX plane. The ceiling conductor 15 does not cover the entire opening above the ground conductor 11 surrounded by the side conductor 14; a pair of openings 16 and 17 of the same rectangular shape are formed between the side conductor 14 and the side edge in the X direction of the ceiling conductor 11. The openings 16 and 17 are symmetric with respect to the ZY plane. The coaxial power supply part 12 is arranged on the origin point. The antenna element 13 is made of a conductive wire arranged inside the monopole antenna along the + axis in the Z direction, and one end of the element 13 is connected to the coaxial power supply part 12. As a result, the openings 16 and 17 are arranged symmetric with respect to the antenna element 13.

Figure 2:
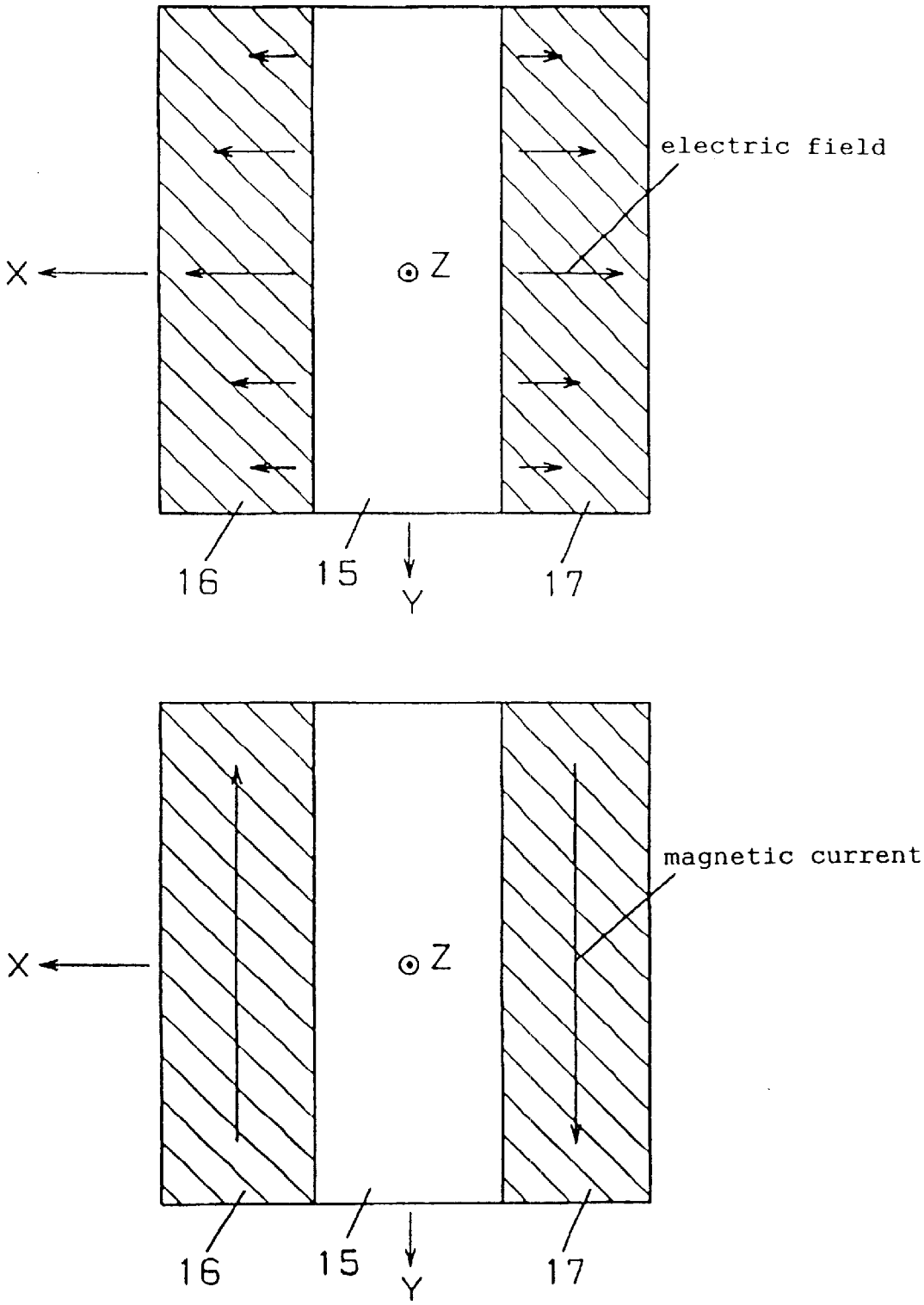
FIG. 2 is a diagram showing the operational principle of the first embodiment.

Behaviors of the antenna will be described with reference to FIG. 2.

A radio wave having a frequency of f0 is radiated from the antenna element 13. The wave is radiated out into space through the openings 16 and 17. In the present embodiment, the openings 16 and 17 are arranged to be symmetric with respect to the antenna element 13, which is the wave radiation source, and the electric fields excited to the openings 16 an 17 by the antenna element. 13 are formed in the opposite directions to each other as shown in FIG. 2A. The electric fields excited to the openings 16 and 17 are explained as follows by being replaced by magnetic currents. As shown in FIG. 2B, linear magnetic current sources having the same amplitude are caused in the directions opposite to each other and parallel to the Y axis in the openings 16 and 17.

The radiation of waves in the monopole antenna is considered to come from these two magnetic current sources. To be more specific, the radiation of radio waves in the monopole antenna can be regarded as mixture radiation due to an antenna array having these two magnetic current sources arranged in parallel.

In a general antenna array, the direction to intensify radio waves depends on the array factor determined by the phase difference of the currents supplied to the antenna elements and the distance between the antenna elements. The radio waves for the antenna array as a whole is the product of the array factor and the radiation pattern of a single antenna element. The approximate radiation pattern of the antenna will be found by replacing the radiation pattern of the single antenna element by the radiation pattern due to a single linear magnetic current source.

To be more specific, since magnetic current sources are arranged symmetric with respect to the ZY plane, the radio waves radiated from the two magnetic current sources have reversed phases each other and are compensated each other with the same amplitude on the plane parallel to the ZY plane. Thus, the radio waves are hardly radiated in the direction parallel to the ZY plane. The plane parallel to the ZX plane has a direction in which the radio waves radiated form the two magnetic current sources have the same phase, and the radio waves are intensified in that direction. For example, when the distance between the magnetic current sources is ½ wavelength in a free space, the radio waves are intensified in the +X direction and the −X direction because they have the same phase in the X axis direction.

Thus, this structure of the monopole antenna can bring the effects of an antenna array out of a single antenna element, thereby changing the directivity of the monopole antenna.

Furthermore, extending the length of the openings 16 and 17 in the Y direction makes the magnetic current sources longer, thereby narrowing the radiation in the X direction so as to increase the gain. In short, the gain can be adjusted by the length of the openings 16 and 17.

A monopole antenna having a finite-size ground conductor generally has a radio wave diffraction at the edge of the ground conductor; the radio wave radiated from the monopole antenna having a finite-size ground conductor is the sum of the radio waves from the antenna elements and the diffraction waves at the edge of the ground conductor.

This holds true in the monopole antenna of the present embodiment. Diffraction occurs at all the edges and folded portions of the ceiling conductor 15, the side conductor 14, and the ground conductor 11. The influence of the diffraction waves becomes greater particularly at the edge of the ceiling conductor 15 when the ceiling conductor 15 has the openings 16 and 17 like in the present embodiment.

As described hereinbefore, in the monopole antenna of the present embodiment, the directivity of the radio waves can be changed according to the size and shape of each of the ceiling conductor 15, the side conductor 14, and the ground conductor 11, in addition to the position, number, and size of the openings 16 and 17.

Figure 3:
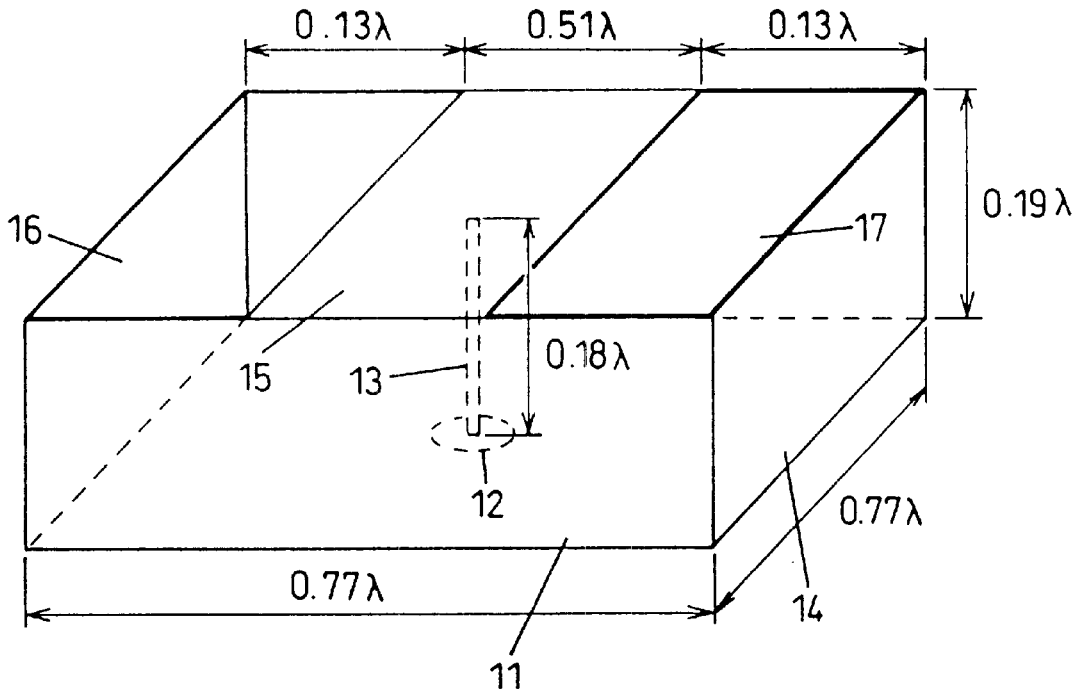
FIG. 3 is a rough perspective view showing a prototype of the first embodiment.
Figure 4:
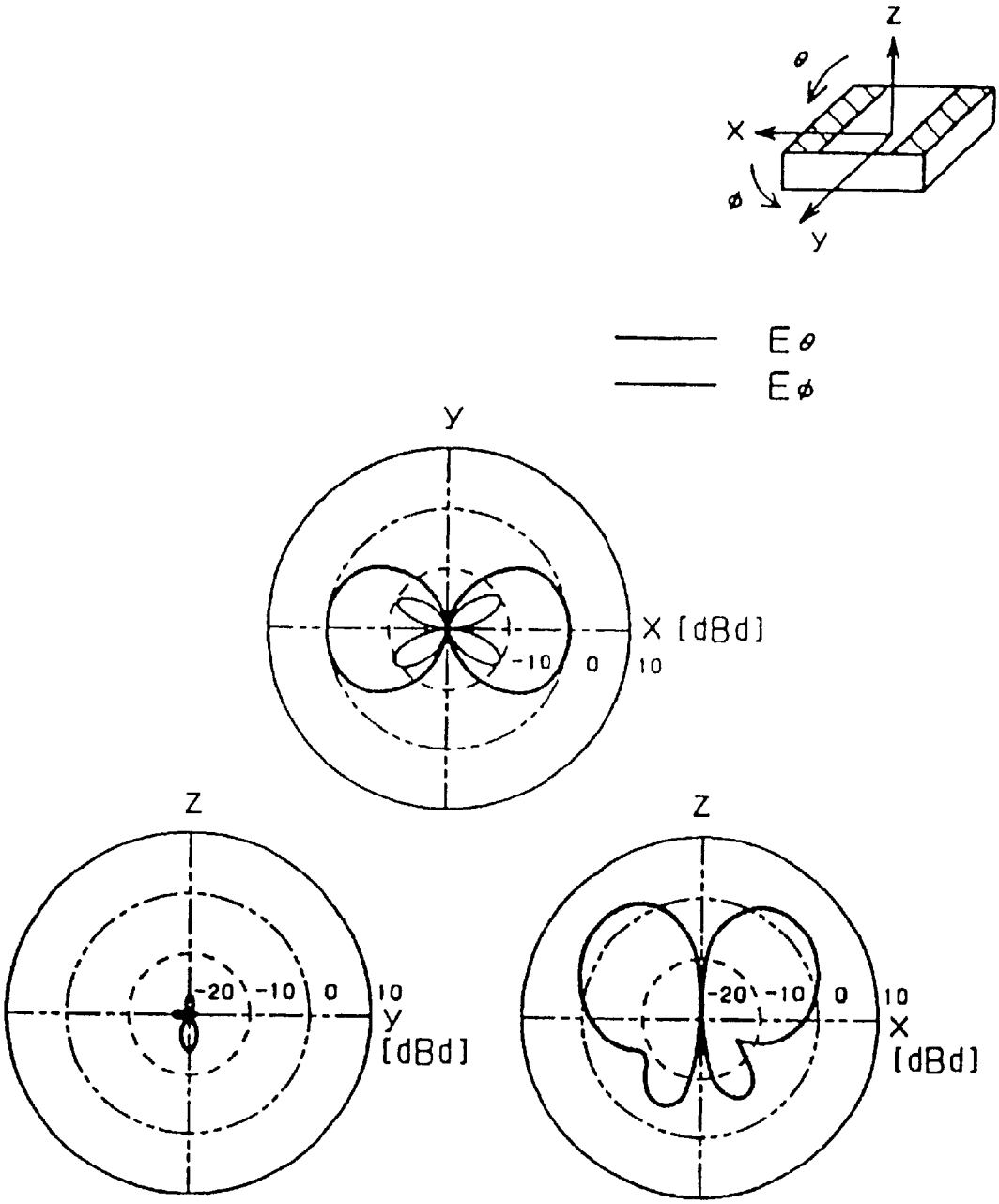
FIG. 4 is diagrams showing the radiation directivity of the prototype of FIG. 3.
Figure 5:
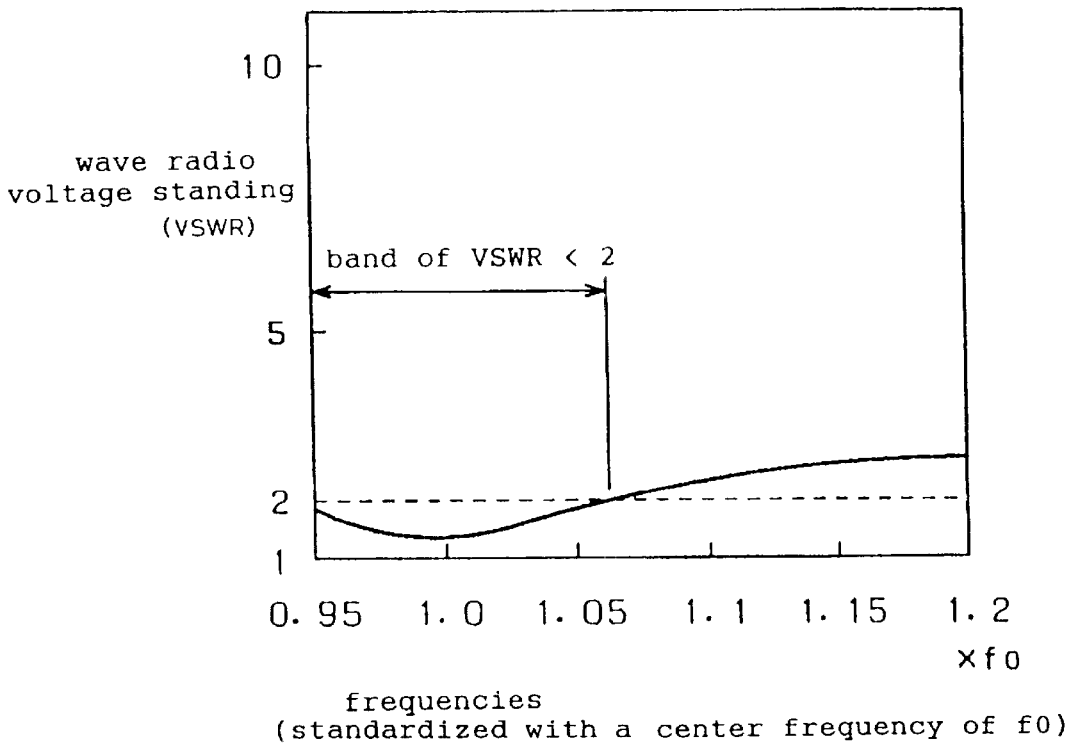
FIG. 5 is a graph showing the impedance characteristics of the prototype of FIG. 3.

A working prototype of an antenna, its radio directivity, and input impedance characteristics are shown in FIGS. 3, 4, and 5, respectively.

The prototype is as follows. The ground conductor 11 was made to be a square of 0.76×0.76 wavelength, referred to the free space wavelength. The height of the side conductor 14 was made 0.19 wavelength. The ceiling conductor 15 was made to be a rectangle having one side with a length of 0.50 wavelength parallel to the X axis and the other side with a length of 0.76 wavelength parallel to the Y axis. The openings 16 and 17 were each made to be a rectangle having one side with a length of 0.13 wavelength parallel to the X axis and the other side with a length of 0.76 wavelength parallel to the Y axis. The openings 16 and 17 thus structured were arranged at both edges of the ceiling conductor 15 in the X axis direction to be symmetric with respect to the ZY plane. The coaxial power supply part 12 was arranged on the origin point. The antenna element 13 was made of a conductive wire arranged along the Z axis to have a length of 0.18 wavelength. The monopole antenna thus structured becomes symmetric with respect to the ZX plane and the ZY plane.

FIG. 4 shows the radio directivity of the monopole antenna with the above-mentioned structure. The radio directivity is calibrated in 10 dB, and the unit is dBd, referred to the gain of a dipole antenna.

Figure 37A:
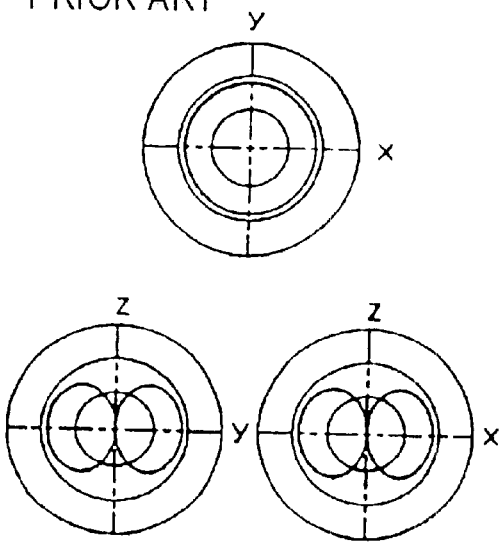
FIG. 37(A) PRIOR ART
FIG. 37 is a diagram showing the radio directivity of the first prior art.
Figure 37B:
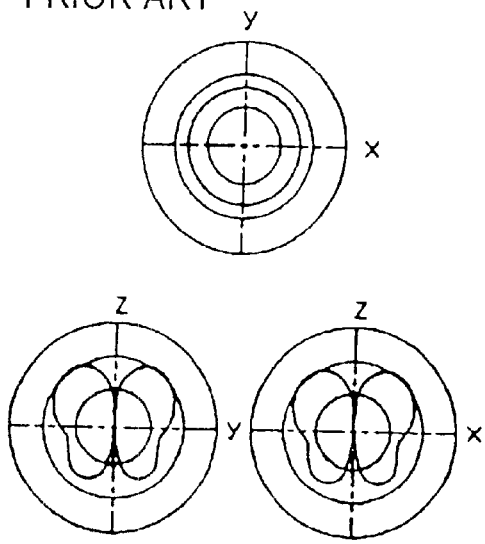
FIG. 37(B) PRIOR ART
Figure 37C:
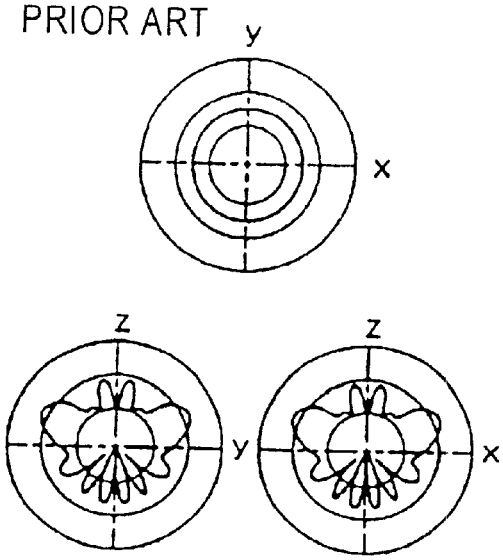
FIG. 37(C) PRIOR ART
Figure 37D:
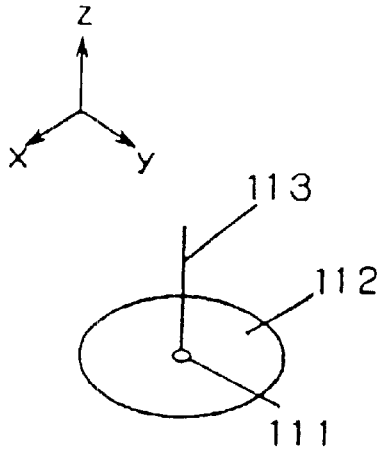
FIG. 37(D) PRIOR ART
Figure 38:
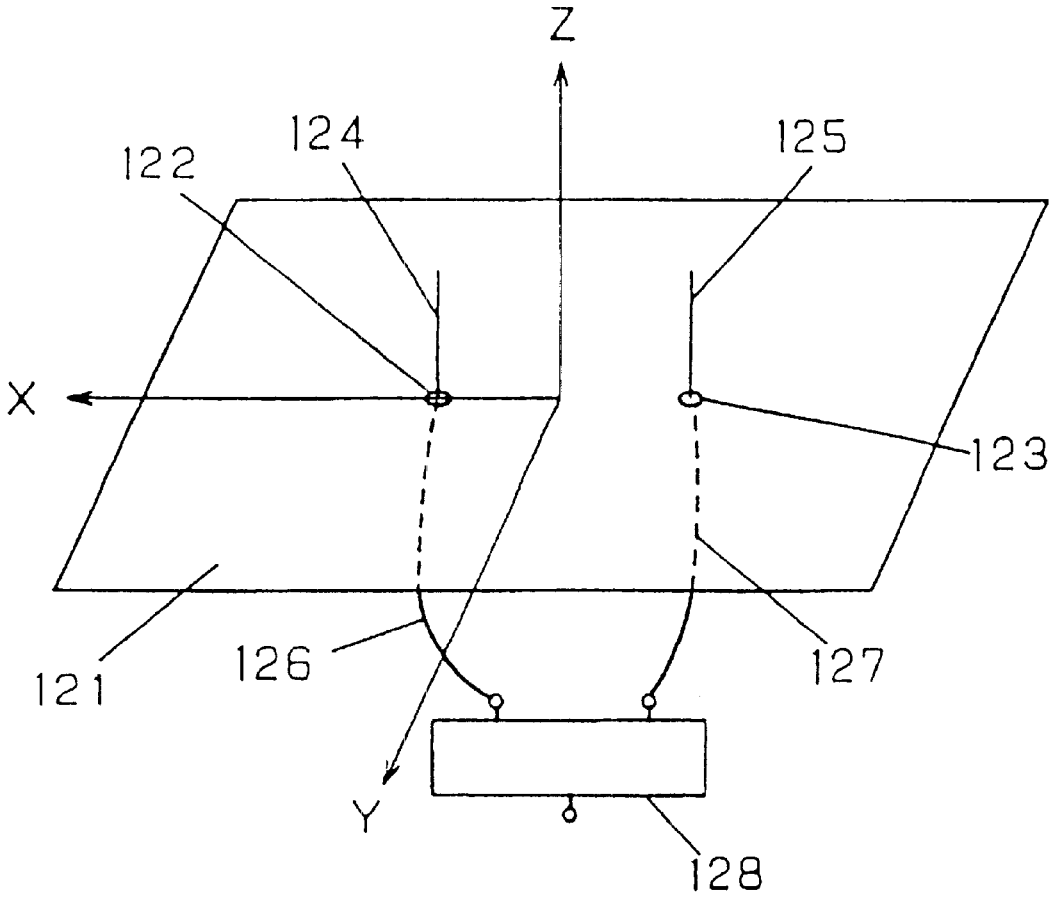
F I G. 38 PRIOR ART
FIG. 38 is a rough perspective view of a second prior art.
Figure 39:
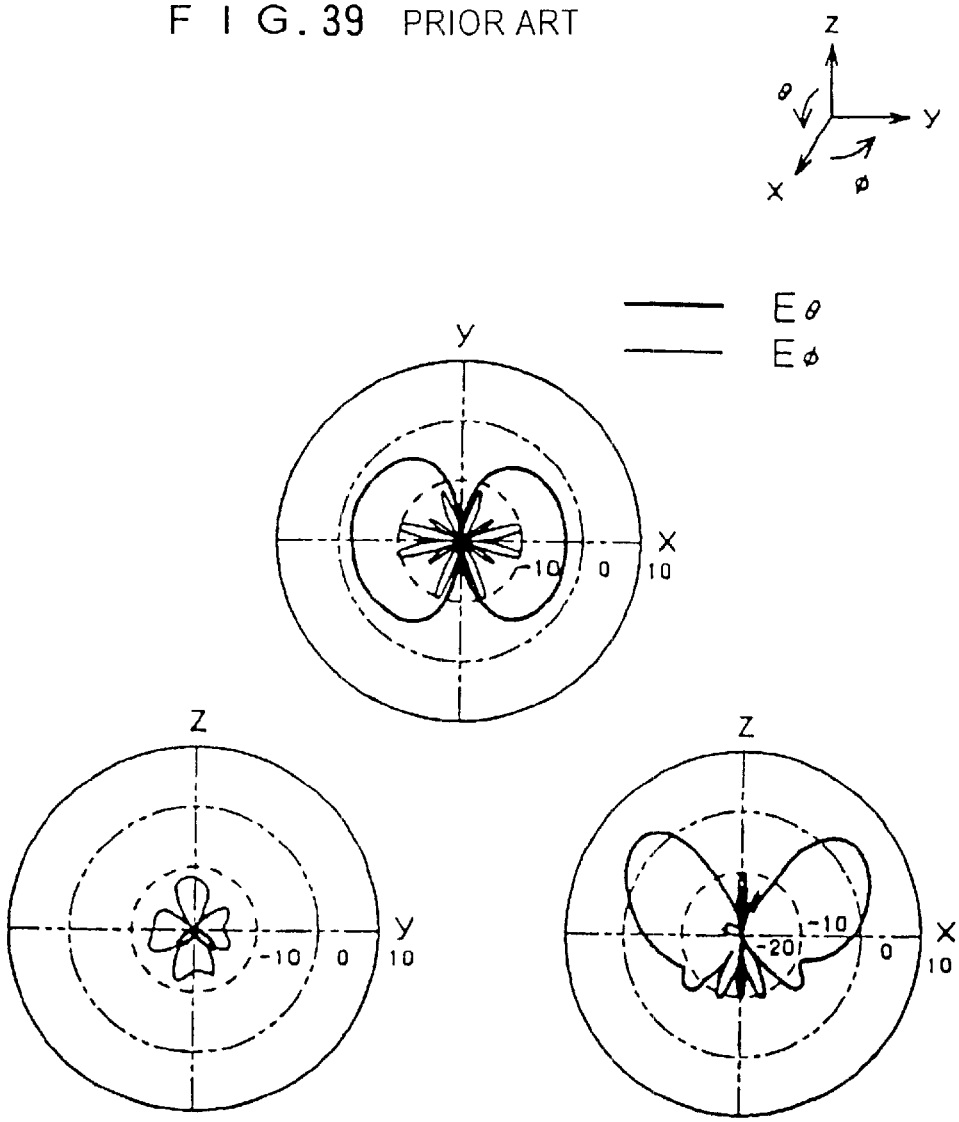
F I G. 39 PRIOR ART
FIG. 39 is a diagram showing the radio directivity of the second prior art.

In this monopole antenna, radio wave radiation is reduced in the Y direction and intensified in the X direction. A comparison with the characteristics of the prior art monopole antenna shown in FIG. 37B indicates that the radiation is intensified by about 2.4 dB in the maximum radiation direction. Furthermore, the antenna does not radiate waves to the bottom side and radiates strong waves to the top side. Particularly strong waves are radiated in the diagonally horizontal direction of the antenna, showing strong directivity in this direction. The side conductor 14 surrounding the antenna elements 13 and the ground conductor 11 together reduce the radiation to the bottom side, or in the −Z direction. Hence, the monopole antenna is suitable to be installed in a narrow indoor space like a corridor.

Since the monopole antenna has the openings 16 and 17 for wave radiation arranged on the antenna ceiling portion, and the antenna element 13 as a radiation source surrounded by the ground conductor 11 and the side conductor 14, the radiation waves are not strongly affected by the antenna arrangement environment in the antenna side and bottom directions. This makes it possible that when the monopole antenna is installed on the indoor ceiling, the antenna is imbedded in the indoor ceiling with the antenna ceiling portion downwards in such a manner that the ceiling conductor 15 forms a single plane with the ceiling of the room which is radiation space. As a result, the antenna becomes inconspicuous without projecting from the ceiling to be an eyesore.

FIG. 5 shows the VSWR (a voltage standing wave ratio) characteristics of the monopole antenna when input impedances are matched with 50 Ω. As shown in FIG. 5, the monopole antenna resonates at a frequency of f0, and has an about 10% frequency band where the VSWR is 2 or below. Thus, the monopole antenna has excellent characteristics in terms of impedance characteristics.

In the monopole antenna, the antenna element height is 0.18 wavelength, which is lower than the ordinary ¼ wavelength monopole antenna element. The reason for this is as follows. The ceiling conductor 15 is arranged at a height of 0.19 wavelength very close to the tip of the antenna element 13, so that the capacitive bonding is caused between them, which becomes equivalent to having a capacitive load at the tip of the antenna element 13. This brings about top loading effects, thereby decreasing the antenna element height.

This monopole antenna is characterized in that the antenna element 13 and the ceiling conductor 15 are arranged very closely to each other, so that a minor increase or decrease in the distance between them can make the input impedances unstable. To stabilize the input impedance characteristics, the distance between the antenna element 13 and the ceiling conductor 15 can be fixed by disposing a spacer made of an insulator, a dielectric member, or the like.

As described hereinbefore, the structure of this monopole antenna can make the antenna element 13 low-profile, which makes the antenna inconspicuous and far from being an eyesore when it is imbedded on an indoor ceiling.

In the case where the monopole antenna is symmetric with respect to the ZY plane and the ZX plane like the present embodiment, the directivity of the radio waves from the antenna becomes symmetric with respect to the ZY plane and the ZX plane.

Hence, the first embodiment achieves a compact and excellent monopole antenna having a simple structure and desired directivity.

(Embodiment 2)

Figure 6A:
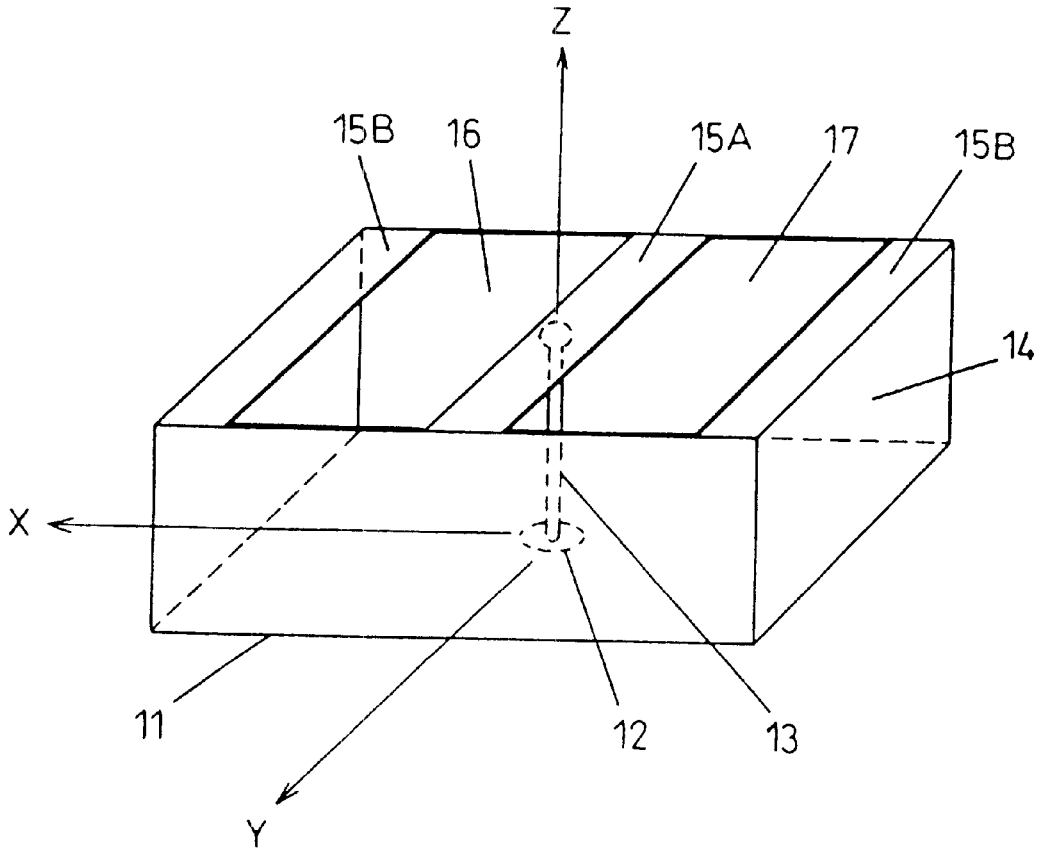
FIG. 6A is a rough perspective view showing a second preferred embodiment of the present invention.
Figure 6B:
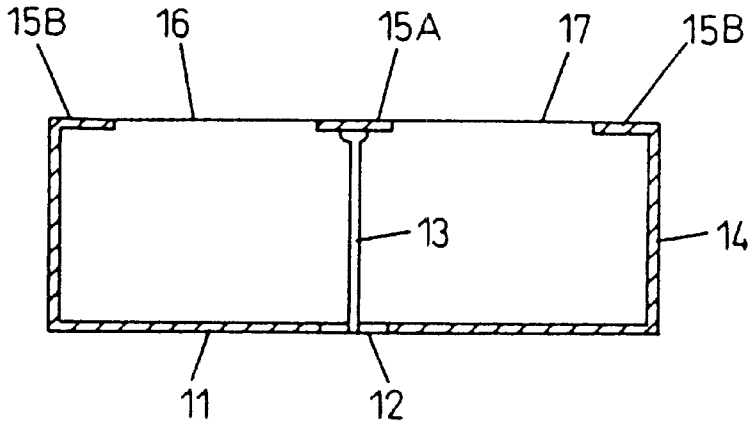
FIG. 6B is a cross sectional view of FIG. 6A.

The second embodiment of the present invention will be described as follows with reference to FIG. 6, where like components are labeled with like reference numerals with respect to FIG. 1.

The monopole antenna of the present embodiment is characterized by the antenna element 13. One end of the antenna element 13 is electrically connected to the coaxial power supply part 12, and the other end to the ceiling conductor 15.

The monopole antenna behaves in the same manner as that of the first embodiment.

In the first embodiment, the ceiling conductor 15 and the tip of the antenna element 13 may be arranged very close to each other. In this case, a change in the distance between them is likely to vary the input impedances of the antenna, thereby deteriorating the matching conditions with the coaxial power supply part 12. As a result, less power is supplied to the antenna element 13, which reduces the radiation efficiency of the antenna.

In contrast, in the present embodiment, the ceiling conductor 15 and the antenna element 13 are combined with soldering or the like so as to stabilize the electric and mechanical relation between them. This enhances the stability of the structure and impedance characteristics of the antenna.

Although it is possible to dispose a spacer made of an insulating member or a dielectric member as described in the first embodiment, the structure in the second embodiment is superior in some cases in terms of production easiness due to simplification of the structure.

Figure 7:
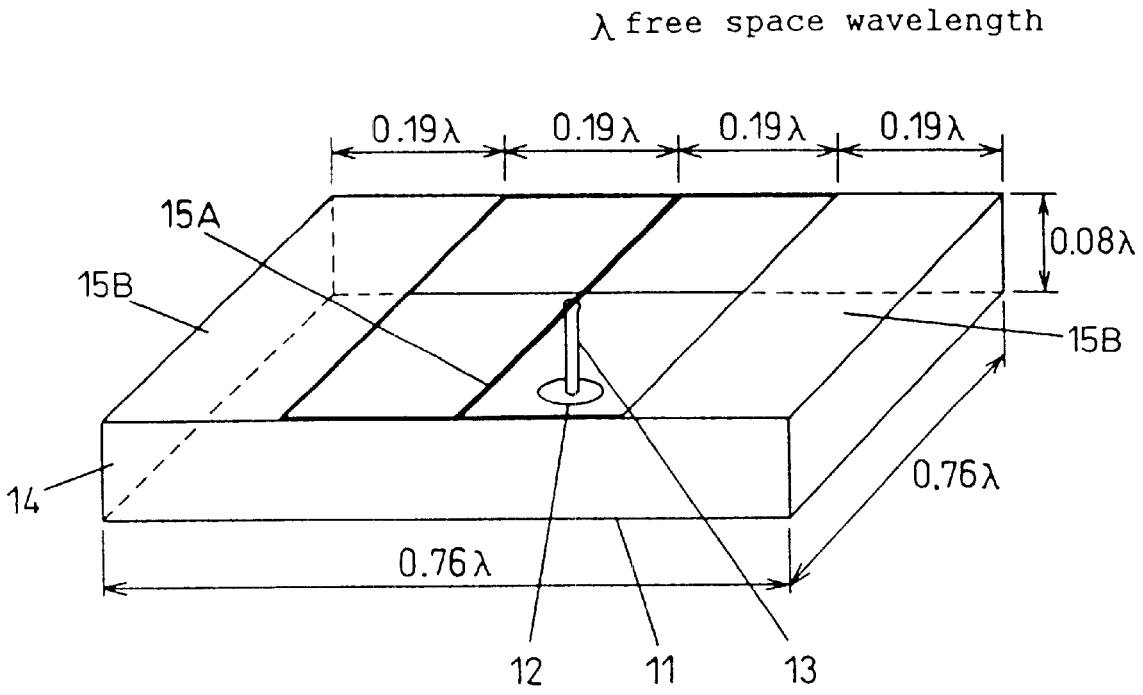
FIG. 7 is a rough perspective view showing a prototype of the second embodiment.
Figure 8:
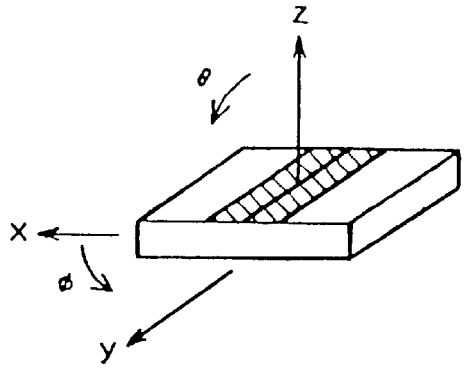
FIG. 8 is diagrams showing the radiation directivity of the prototype of FIG. 7.
Figure 8:
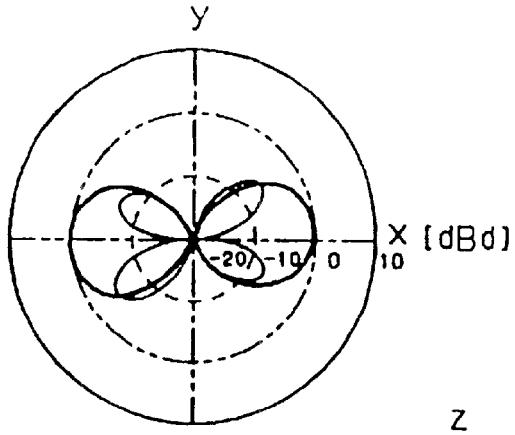
Figure 8:
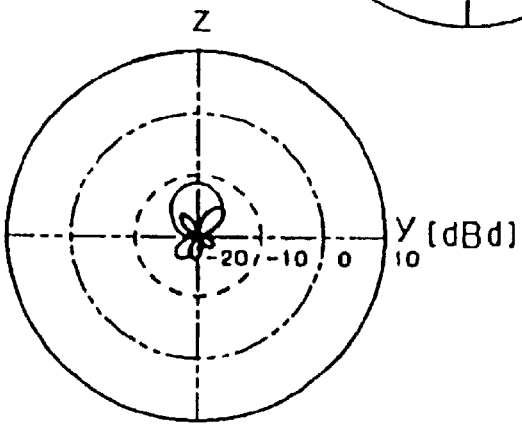
Figure 8:
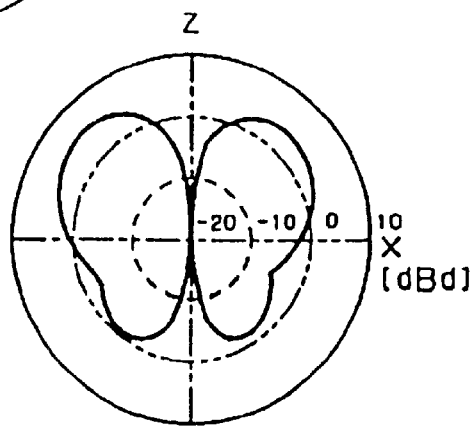
Figure 9:
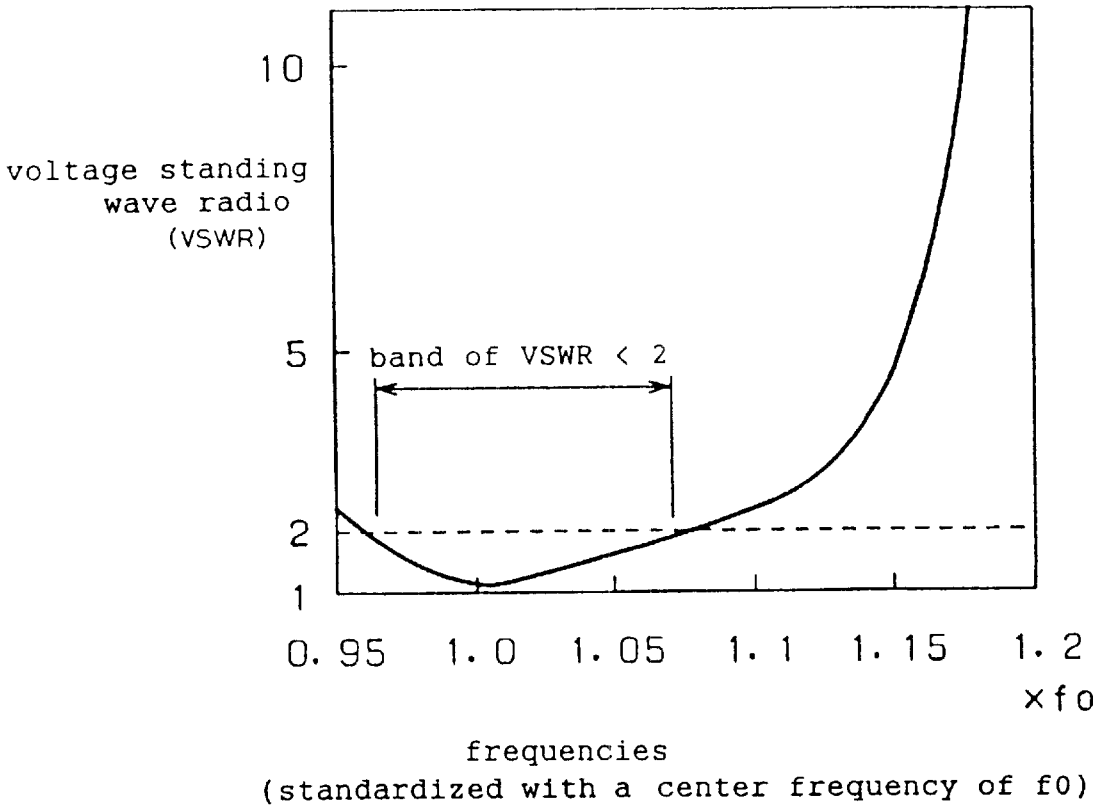
FIG. 9 is a graph showing the impedance characteristics of the prototype of FIG. 7.

A working prototype antenna is shown in FIG. 7 and its radiation directivity and input impedances are shown in FIGS. 8 and 9, respectively.

The prototype was as follows. The ground conductor 11 was made to be a square of 0.76×0.76 wavelength, referred to the free space wavelength. The height of the side conductor 14 was made 0.08 wavelength. The ceiling conductor 15 was composed of a linear conductor 15A and two rectangular conductors 15B. The coaxial power supply part 12 was arranged on the origin point. The linear conductor 15A was made to have 0.76 wavelength and arranged to be parallel to the ceiling conductors 15A and 15B and also parallel to the Y axis. Both ends of the linear conductor 15A were electrically connected to the side conductor 14. The rectangular conductors 15B each have a side of 0.19 wavelength parallel to the X axis and the other side of 0.76 wavelength parallel t the Y axis. These rectangular conductors 15B were arranged at both ends of the antenna ceiling portion in the X direction. The openings 16 and 17 were formed between the rectangular conductors 15B and the linear conductor 15A. The openings 16 and 17 each have a side of 0.19 wavelength parallel to the X axis and the other side of 0.76 wavelength parallel to the Y axis. The tip of the antenna element 13 was electrically connected to the center in the longitudinal direction of the linear conductor 15A. The antenna element 13 was a conductive wire arranged in the Z axis to have 0.08 wavelength. The monopole antenna thus structured becomes symmetric with respect to the ZX plane and the ZY plane.

FIG. 8 shows the radiation directivity of the above-structured monopole antenna. The radio directivity is calibrated in 10 dB, and the unit is dBd, referred to the gain of a dipole antenna.

In this monopole antenna, radio wave radiation is reduced in the Y direction and intensified in the X direction. A comparison with the characteristics of the prior art monopole antenna shown in FIG. 37B indicates that the radiation is intensified by about 4 dB in the maximum radiation direction. Furthermore, as shown in FIG. 8 the antenna does not radiate waves to the bottom side and radiates strong waves to the top side. Particularly strong waves are radiated in the diagonally horizontal direction of the antenna, showing strong directivity in this direction. The side conductor 14 surrounding the antenna elements 13 and the ground conductor 11 together reduce the radiation to the bottom side, or in the −Z direction. Hence, the monopole antenna is suitable to be installed in a narrow indoor space like a corridor.

Because of the same reason mentioned in the first embodiment, the radiation waves are not strongly affected by the antenna arrangement environment in the antenna side and bottom directions. This makes it possible that the monopole antenna is installed to form a single plane with the indoor ceiling so that the ceiling portion of the antenna faces the radiation space. As a result, the antenna becomes inconspicuous without projecting from the ceiling to be an eyesore.

FIG. 9 shows the VSWR characteristics of the monopole antenna when input impedances are matched with 50 Ω. As shown in FIG. 9, the monopole antenna resonates at a frequency of f0, and has an about 10% frequency band where the VSWR is 2 or below. Thus, the monopole antenna has excellent characteristics in terms of impedance characteristics.

In the monopole antenna, the antenna element height is 0.08 wavelength, which is lower than the ordinary ¼ wavelength monopole antenna element. This is due to the top loading effects like in the first embodiment.

Thus in the structure of the antenna of the present embodiment, when not allowed to be imbedded on the indoor ceiling, the antenna can be inconspicuous without being an eyesore and shorter than projecting from the ceiling, partly because of the low-profile effects of the antenna element.

Similar to the first embodiment, the second embodiment has an effect that the directivity of the radio waves from the antenna becomes symmetric with respect to the ZY plane and the ZX plane by making the monopole antenna be symmetric with respect to the ZY plane and the ZX plane.

Hence, the second embodiment achieves a compact and excellent monopole antenna having a simple structure and desired directivity.

(Embodiment 3)

Figure 10A:
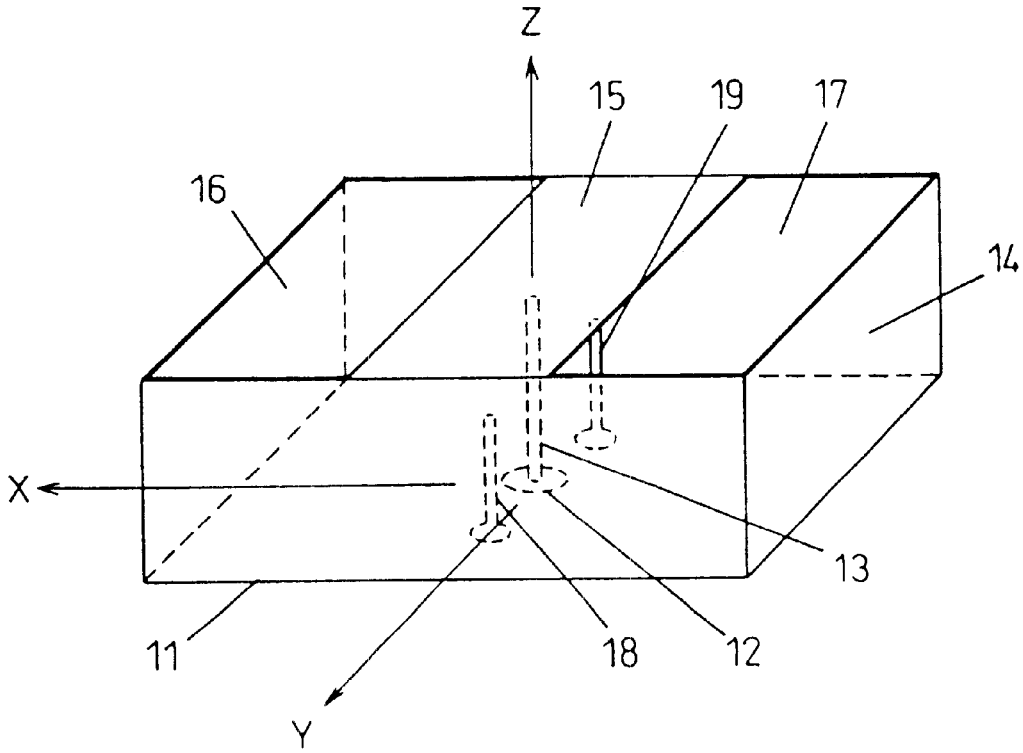
FIG. 10A is a rough perspective view showing a third preferred embodiment of the present invention.
Figure 10B:
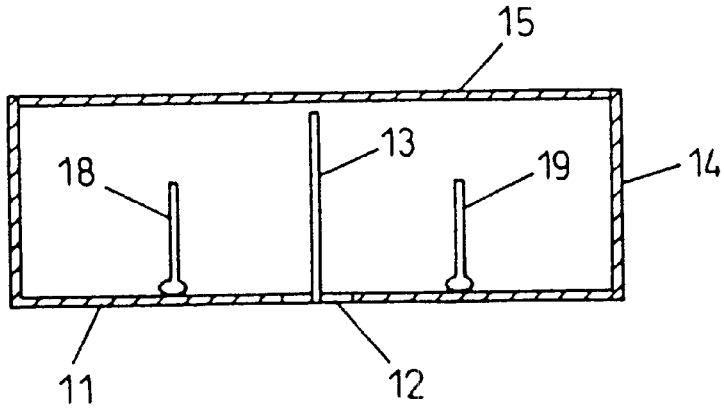
FIG. 10B is a cross sectional view of FIG. 10A.

A third embodiment of the present invention will be described as follows with reference to FIGS. 10A and 10B where like components are labeled with like reference numerals with respect to FIG. 1.

The monopole antenna of the third embodiment is characterized by providing matching conductors 18 and 19, which are made of linear conductors and arranged in parallel to the Z axis on the ZY plane. The matching conductors 18 and 19 are further arranged to be symmetric with respect to the antenna element 13 located on the +Z axis. One end of each of the matching conductors 18 and 19 is electrically connected to the ground conductor 11.

The monopole antenna behaves in the same manner as that of the first embodiment.

In the first and second embodiments, the matching between the coaxial power supply part 12 and the monopole antenna may be out of order. In that case, the antenna element 13 is supplied with less power, which deteriorates the radiation efficiency of the antenna.

In contrast, the monopole antenna of the present embodiment can make matching conditions with the coaxial power supply part 12 excellent by changing the impedances of the antenna by providing the matching conductors 18 and 19 with a distance between them near the antenna element 13. Enhancing the matching conditions improves the characteristics of the antenna.

Furthermore, arranging the matching conductors 18 and 19 so as not to affect the shape of the openings 16 and 17 allows the radiation directivity having the matching conductors 18 and 19 to be the same as the radiation directivity without them. This is because the substantial radiation source of the monopole antenna is mainly concentrated on the openings 16 and 17. Thus, this monopole antenna can establish excellent matching conditions of impedances without hardly changing desired radiation directivity.

Similar to the first embodiment, in the third embodiment the directivity of the radio waves from the antenna becomes symmetric with respect to the ZY plane and the ZX plane by making the monopole antenna be symmetric with respect to the ZY plane and the ZX plane.

Hence, the third embodiment achieves a compact and excellent monopole antenna having a simple structure and desired directivity.

(Embodiment 4)

Figure 11A:
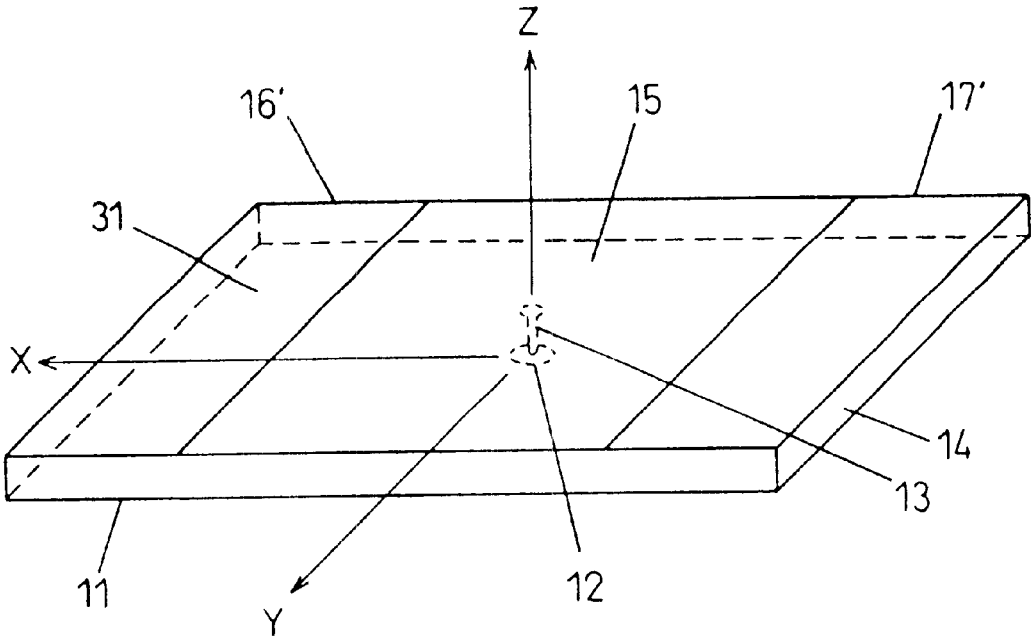
FIG. 11A is a rough perspective view showing a fourth preferred embodiment of the present invention.
Figure 11B:
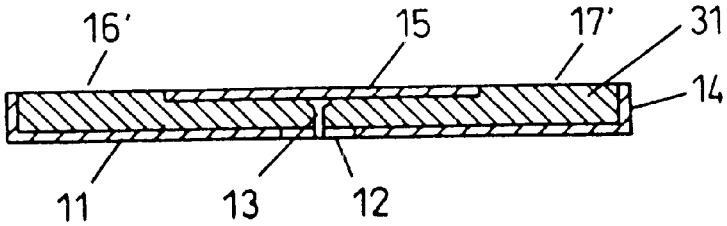
FIG. 11B is a cross sectional view of FIG. 11A.

A fourth embodiment of the present invention will be described as follows with reference to FIGS. 11A and 11B where like components are labeled with like reference numerals with respect to FIG. 1.

The monopole antenna of the fourth embodiment is characterized in that a space inside the antenna surrounded by the ground conductor 11, the side conductor 14, and the ceiling conductor 15 is filled with a dielectric member 31. Assume that the ratio (relative permittivity) of the permittivity of the dielectric member to the permittivity $\epsilon 0$ in a vacuum is $\epsilon\gamma$, the wavelength in the dielectric member becomes $1/\sqrt{\epsilon\gamma}$ times the wavelength in a vacuum. Since $\epsilon\gamma$ is not less than 1, the wavelength becomes shorter inside the dielectric member. Therefore, integrating the dielectric member 31 to the antenna makes the antenna compact and low-profile.

Figure 12:
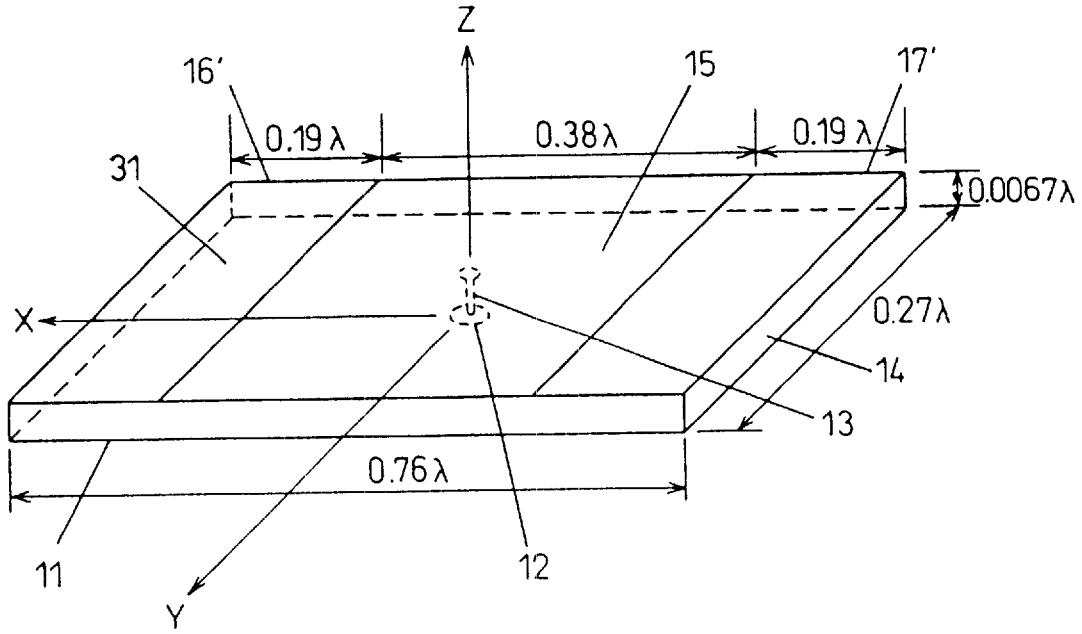
FIG. 12 is a rough perspective view showing a prototype of the fourth embodiment.
Figure 13:
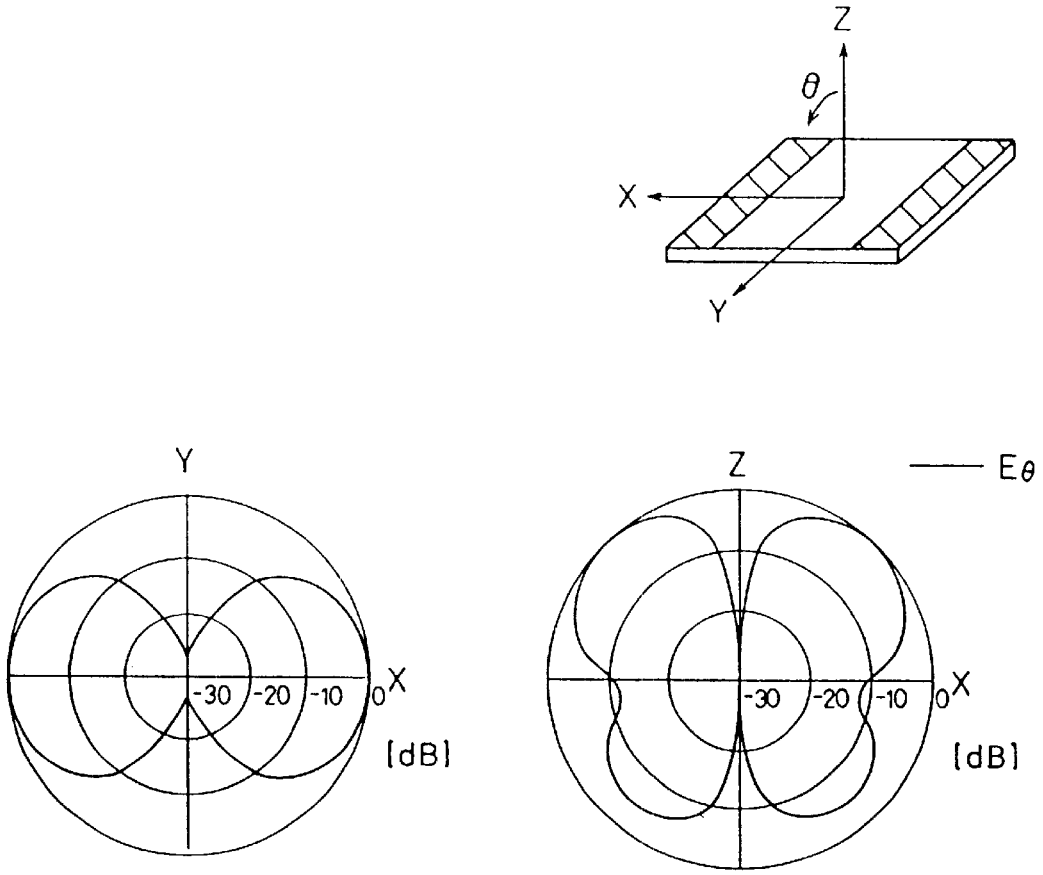
FIG. 13 is diagrams showing the radiation directivity of the prototype of the fourth embodiment.
Figure 14:
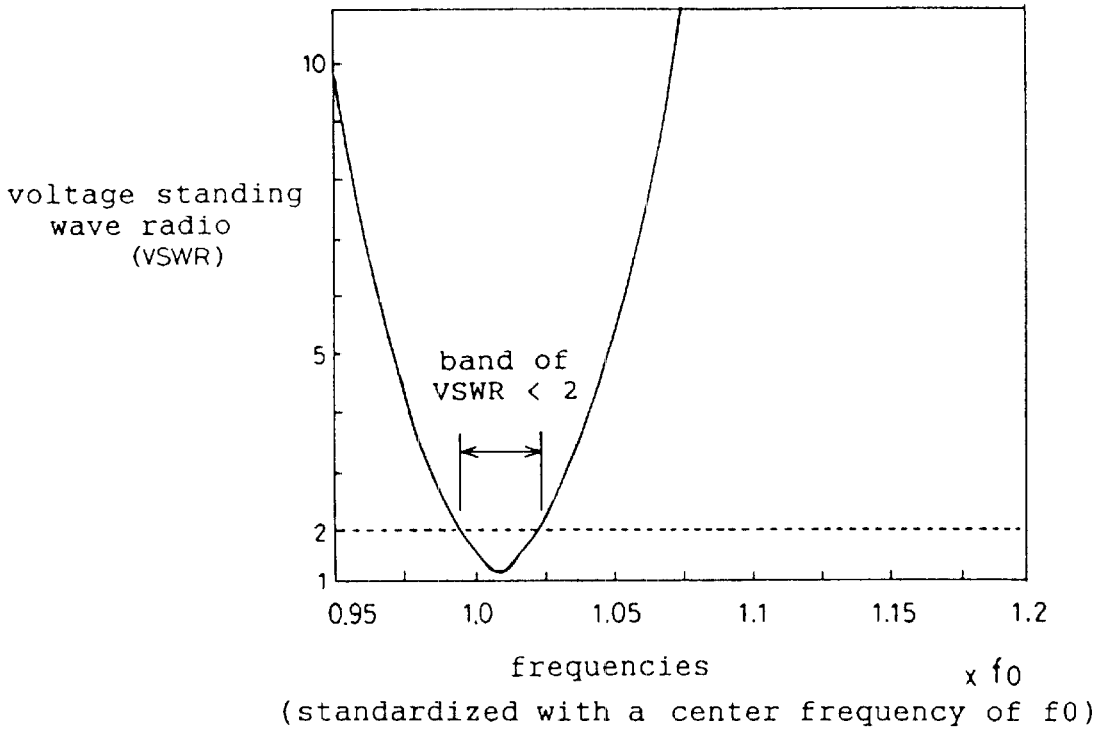
FIG. 14 is a graph showing the impedance characteristics of the prototype of the fourth embodiment.

A working prototype antenna is shown in FIG. 12, and its radiation directivity and VSWR (voltage standing wave ratio) characteristics of input impedances matched with 50 Ω are shown in FIGS. 13 and 14, respectively.

The relative permittivity $\epsilon\gamma$ of the dielectric member 31 was made 3.6. The ground conductor 11 was made to be a rectangle having a longer side with a length of 0.76 wavelength and the shorter side with a length of 0.27 wavelength, referred to the free space wavelength. The height of the side conductor 14 was made 0.0067 wavelength. The ceiling conductor was made to be a rectangle having a side with a length of 0.38 wavelength parallel to the X axis and the other side with a length of 0.27 wavelength parallel to the Y axis. The openings 16' and 17' were formed by peeling away from the dielectric member 31 the conductive film formed as the ceiling conductor 15 on the surface of the dielectric member 31. The openings 16' and 17' were each made to be a rectangle having a side with a length of 0.19 wavelength parallel to the X axis and the other side With a length of 0.27 wavelength parallel to the Y axis. The openings 16' and 17' thus formed are arranged at both ends of the ceiling conductor 15 along the X axis to as to be symmetric with respect to the ZY plane. The antenna element 13 was a conductive wire having a length of 0.0067 wavelength. The coaxial power supply part 12 was arranged in the origin point, and one end of the antenna element 13 was electrically connected to the ceiling conductor 15. The monopole antenna thus structured is symmetric with respect to the ZY plane and the ZY plane.

In FIG. 13 the radio directivity is calibrated in 10 dB, which is within specifications at the maximum value. This monopole antenna hardly radiates waves to the bottom side and radiates strong waves to the top side. Particularly strong waves are radiated in the diagonally horizontal direction of the antenna, showing characteristics suitable to be installed in a narrow indoor space like a corridor.

As shown in FIG. 14, the monopole antenna resonates at a frequency of f0, and has an about 2% frequency band where the VSWR is 2 or below. Thus, the monopole antenna has excellent characteristics in terms of impedance characteristics.

In the monopole antenna, the antenna element height can be 0.0067 wavelength. This corresponds to 1 mm in transmitting or, receiving a signal of 2 GHz, and is sufficiently lower in height than the prior art ¼ wavelength monopole antenna element, and further lower than those in the above-mentioned first through third embodiment. This can be done by filling the dielectric member 31 inside the antenna.

When an antenna is installed on a ceiling or wall in a room, if it is not allowed to be imbedded there, the antenna capable of reducing its height is preferable because of being inconspicuous and not being an eyesore.

The monopole antenna of the present embodiment, which is symmetric with respect to the ZY plane and the ZX plane, has an effect of making the directivity of the radio waves from the antenna be symmetric with respect to each plane parallel to the ZY plane and each plane parallel to the ZX plane.

The monopole antenna, which is filled with the dielectric member 31, can be manufactured using a dielectric substrate having a conductive foil such as a copper foil applied on both sides thereof as follows. A dielectric substrate having a thickness of 0.0067 wavelength and applied with a conductive foil such as a copper foil on both sides thereof is cut to form a rectangle of 0.76×0.27 wavelength. The rectangle is made the dielectric member 31. Then, one of the sides of the conductive foil is removed by etching or a mechanical process so as to form the ceiling conductor 15 and the openings 16' and 17'. The conductive foil on the other side no removed becomes the ground conductor 11. An appropriate hole is formed in the fixed position of the ground conductor 11 (for example, in the center in the plane direction) so as to form the coaxial power supply part 12. A though hole extending from the coaxial power supply part 12 up to the ceiling plane of the dielectric member 31 is formed by etching or a drill process. The tip of a conductive wire extending from the internal conductor of the coaxial power supply part 12 is inserted into the through hole to be projected from the ceiling conductor 15 outside the substrate. The conductive wire is used as the antenna element 13, which is electrically connected to the ceiling conductor 15 by soldering or the like. A side surface of the dielectric member 31 is applied with a copper foil with an adhesive agent so as to form the side conductor 14.

According to the above-mentioned manufacturing. method, the high precision process such as the etching process to form the openings 16' and 17' enhances the manufacturing accuracy of an antenna and achieves a cost reduction due to mass production.

In the monopole antennas of the first to third embodiments not provided with the dielectric member 31, the space inside the antenna leads outside through the openings 16 and 17. Depending on the installment environment of the antenna, the openings 16 and 17 may undesirably bring dust or humid air into the antenna, thereby deteriorating its characteristics. In the monopole antenna of the present embodiment; however, the provision of the dielectric member 31 prevents the deterioration of the characteristics of the antenna, thereby maintaining the reliability for the long term.

Hence, the fourth embodiment achieves a compact and excellent monopole antenna having a simple structure and desired directivity.

Figure 15:
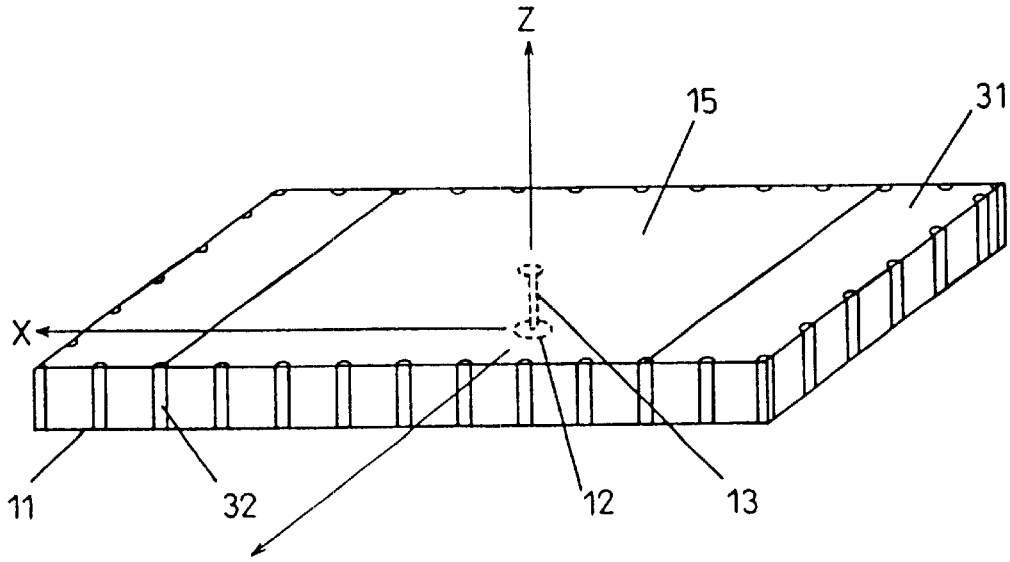
FIG. 15 is a rough perspective view showing a modified example of the fourth embodiment.

In the fourth embodiment, it would be possible to interrupt inside and outside the antenna electrically by employing plural conductive bars 32 instead of the side conductor 14, as shown in FIG. 15. The conductive bars 32 can be formed as follows. Conductive patterns for the ground conductor 11 and the ceiling conductor 15 are formed on a large dielectric substrate which is to be a mother substrate for the plural dielectric members 31. Holes are formed at regular intervals along the dividing lines of the dielectric members 31 in a manner to penetrate the dielectric substrate. The conductive bars 32 are inserted into these holes to connect the ground conductor 11 and the conductive bar 32 each other, and the ceiling conductor 15 and the conductive bars 32 each other electrically. After forming the conductive bars 32, the dielectric substrate is divided into the dielectric members 31. The conductive bars 32 can be made of via holes, which can be formed by applying a through hole etching to the holes or filling the holes with a conductive member.

In the structure shown in FIG. 15, the conductive bars 32 exert the same effects as the side conductor 14 when the distance between adjacent conductive bars 32 is sufficiently short, compared with the wavelength. A combination of the structure of the conductive bars 32 and the technique to process the ceiling conductor 15 such as the above-mentioned etching process can achieve a monopole antenna with high process precision and capable of being mass produced.

In the fourth embodiment, the monopole antenna is filled with the dielectric member 31. However, the present invention is not restricted to this structure; the dielectric member 31 can be put in a part inside the antenna. For example, a monopole antenna can be formed by using a dielectric substrate applied with a conductive foil on its one side and removing the foil by etching or a mechanical process so as to form a dielectric substrate having the ceiling conductor 15 and the openings 16' and 17'; another dielectric substrate having the side conductor 14; and further another dielectric substrate having the ground conductor 11, and combining these substrates. The dielectric substrate having the side conductor 14 can be a single dielectric substrate having the side conductor 14 on the entire side surface thereof. Alternatively, plural dielectric substrates each having the side conductor 14 thereon can be combined to form a frame.

(Embodiment 5)

Figure 16A:
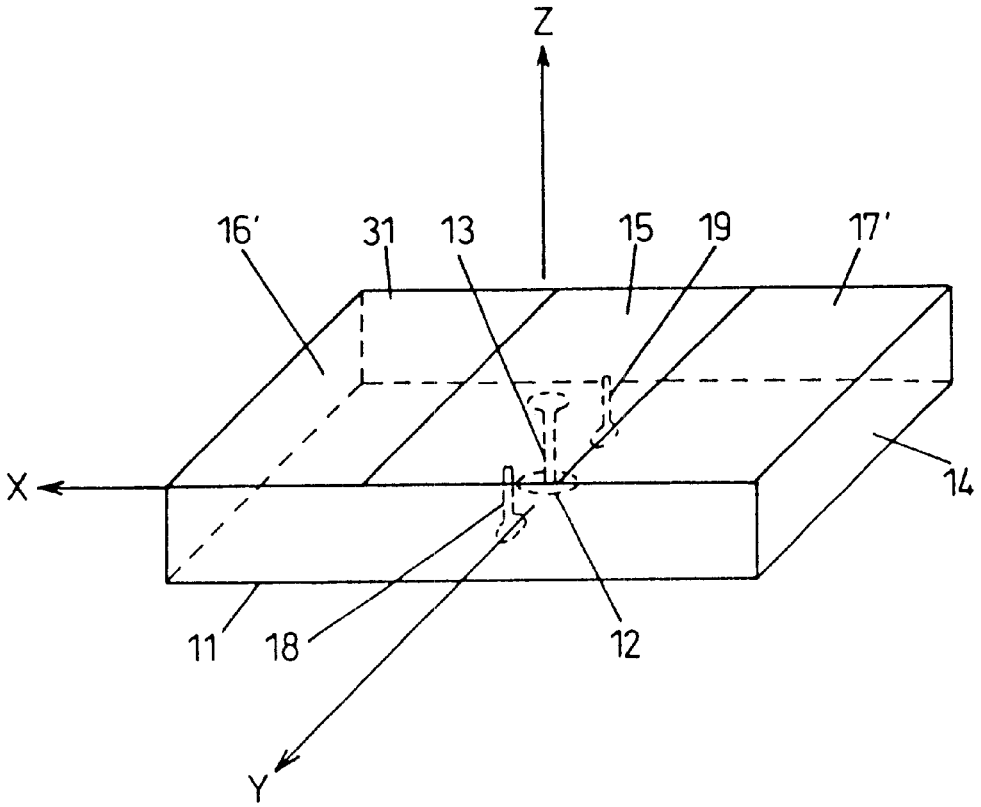
FIG. 16A is a rough perspective view showing a fifth preferred embodiment of the present invention.
Figure 16B:
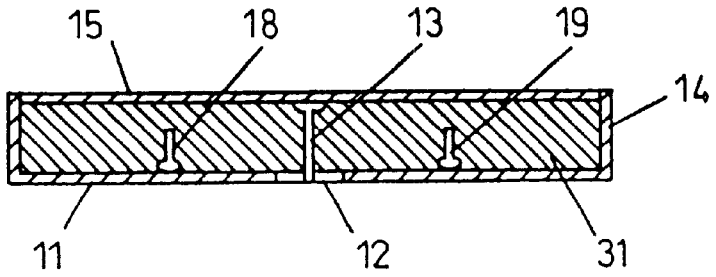
FIG. 16B is a cross sectional view of FIG. 16A.

A fifth embodiment of the present invention will be described as follows with reference to FIGS. 16A and 16B. FIG. 16A is a rough perspective view of the monopole antenna of the fifth embodiment, and FIG. 16B is a sectional view of the antenna taken along the ZY plane of FIG. 16A. The antenna of the present embodiment, which basically has the same structure as that of the fourth embodiment, is characterized by being provided with matching conductors 18 and 19 electrically connected to the ground conductor 11 like in the third embodiment. The matching conductors 18 and 19 are arranged to be symmetric with respect to the antenna element 13 arranged on the +Z axis on the ZY plane. One end of each of the matching conductors 18 and 19 is electrically connected to the ground conductor 11.

In the fifth embodiment, the provision of the matching conductors 18 and 19 apart from each other close to the antenna element 13 can change the impedance of the antenna, thereby having excellent matching conditions with the coaxial power supply part 12. The excellent matching conditions can improve the characteristics of the antenna. Similar to the third embodiment, the matching conditions of the impedance can be improved while hardly changing desired radiation directivity.

As described hereinbefore, the fifth embodiment achieves a compact monopole antenna having excellent impedance matching conditions and desired directivity with a simple structure.

(Embodiment 6)

Figure 17A:
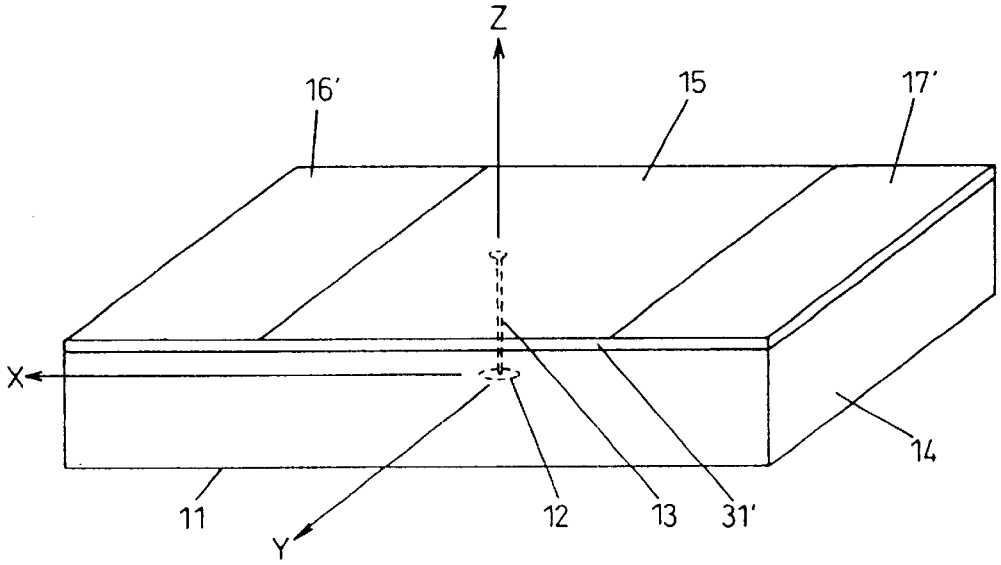
FIG. 17A is a rough perspective view showing a sixth preferred embodiment of the present invention.
Figure 17B:
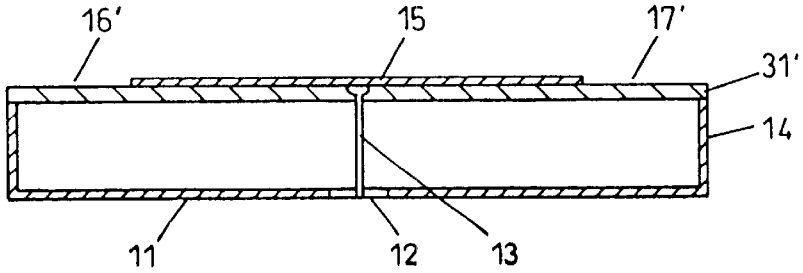
FIG. 17B is a cross sectional view of FIG. 17A.

A sixth embodiment of the present invention will be described as follows with reference to FIGS. 17A and 17B. FIG. 17A is a rough perspective view of the monopole antenna of the sixth embodiment, and FIG. 17B is a sectional view taken along the ZY plane of FIG. 17A.

The antenna of the present embodiment, which basically has the same structure as that of the fourth embodiment, is characterized by being provided with a plane-shaped dielectric member 31' covering not the entire space inside the antenna but a part of it. The surface of the dielectric member 31' is provided with the film ceiling conductor 15 made of a conductive film and the openings 16' and 17' formed by removing the conductive film. The dielectric member 31' is arranged at the end of the ceiling-side opening of the internal space surrounded by the side conductor 14. The internal space is sealed by the dielectric member 31' which functions as a lid.

Thus, the effects to block dust and moisture in the fourth embodiment structure can be fully exerted also by sealing the end of the ceiling-side opening of the internal space by means of the dielectric member 31'. The dielectric member 31', which is arranged at the ceiling side of the antenna in the present embodiment, can be provided at the bottom side. In that case, the ground conductor 11 is formed on the dielectric member 31'.

(Embodiment 7)

Figure 18A:
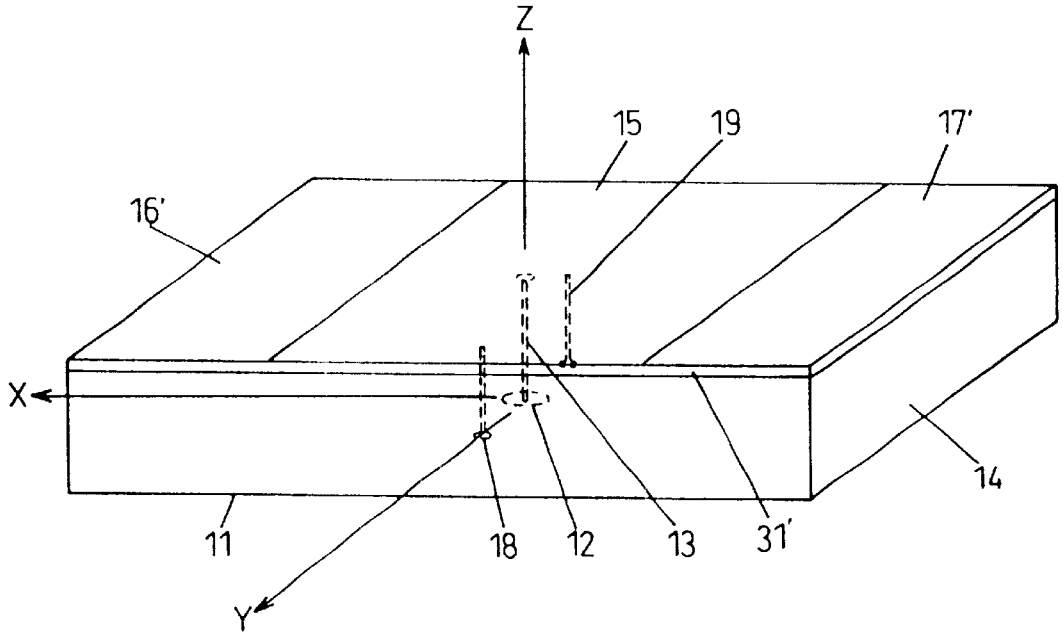
FIG. 18A is a rough perspective view showing a seventh preferred embodiment of the present invention.
Figure 18B:
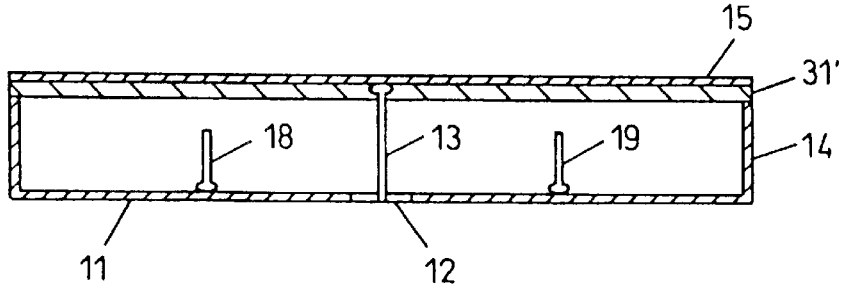
FIG. 18B is a cross sectional view of FIG. 18A.

A seventh embodiment of the present invention will be described as follows with reference to FIGS. 18A and 18B. FIG. 18A is a rough perspective view of the monopole antenna of the seventh embodiment, and FIG. 18B is a sectional view taken along the ZY plane of FIG. 18A. The antenna of the present embodiment has the structure of the sixth embodiment and also has the matching conductors 18 and 19 of the fifth embodiment, in order to match the impedances in the same manner as in the fifth embodiment.

Figure 19A:
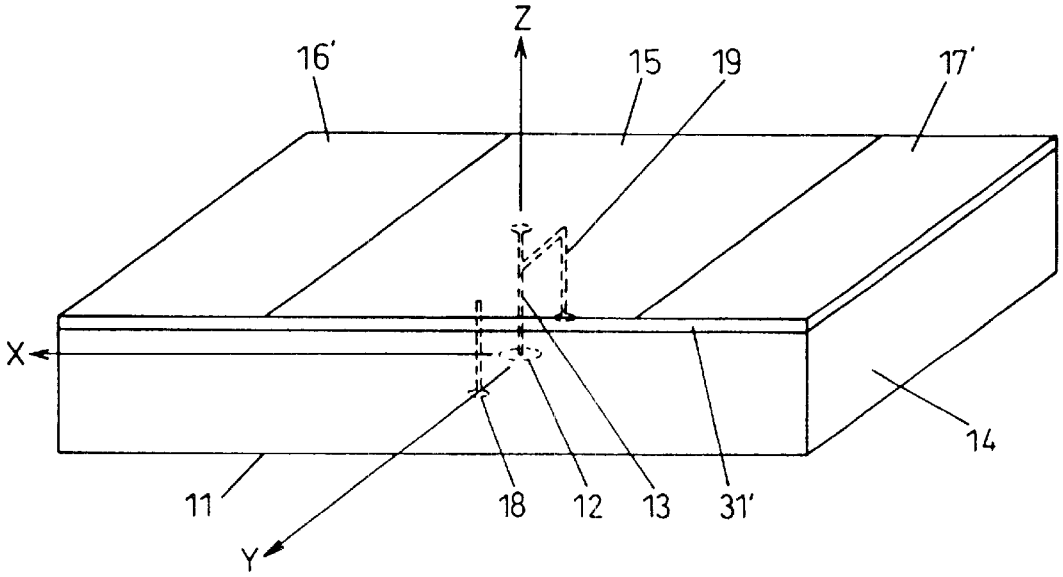
FIG. 19A is a rough perspective view showing a first modified example of the seventh embodiment.
Figure 19B:
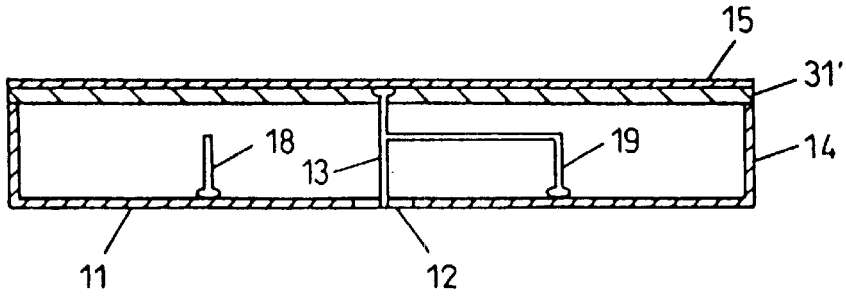
FIG. 19B is a cross sectional view of FIG. 19A.

In the monopole antenna of the present embodiment, the matching conductors 18 and 19 are arranged away from the antenna element 13; however, the present invention is not restricted to this structure. For example, it is possible to electrically connect one end of either or both of the matching conductors 18 and 19 to one end or the central portion of the antenna element 13 as shown in FIGS. 19A and 19B. This structure enhances the impedance of the antenna, making it possible to obtain good matching conditions with the coaxial power supply part 12 when the impedance of the antenna is low.

Figure 20A:
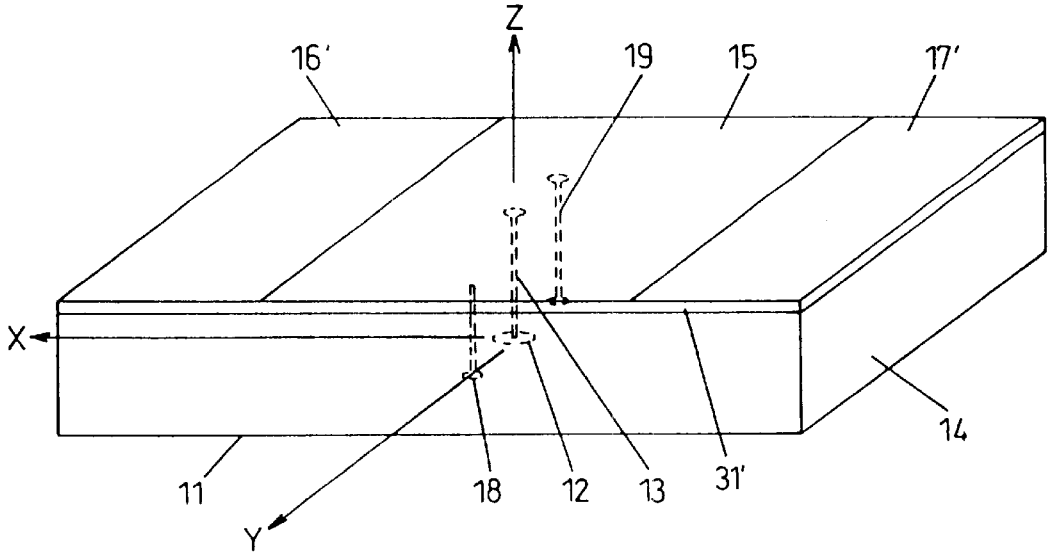
FIG. 20A is a rough perspective view showing a second modified example of the seventh embodiment.
Figure 20B:
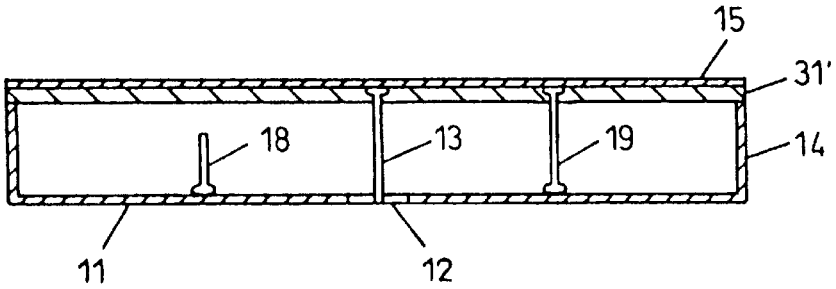
FIG. 20B is a cross sectional view of FIG. 20A.

In the monopole antenna of the present embodiment, the matching conductors 18 and 19 are arranged away from the antenna element 13; however, the present invention is not restricted to this structure. For example, it is possible to electrically connect one end of either or both of the matching conductors 18 and 19 to the ceiling conductor 15 as shown in FIGS. 20A and 20B. This structure can change the impedance of the antenna, thereby obtaining good matching conditions with the coaxial power supply part 12.

(Embodiment 8)

An eighth embodiment of the present invention will be described as follows with reference to FIGS. 21 through 26.

Figure 21:
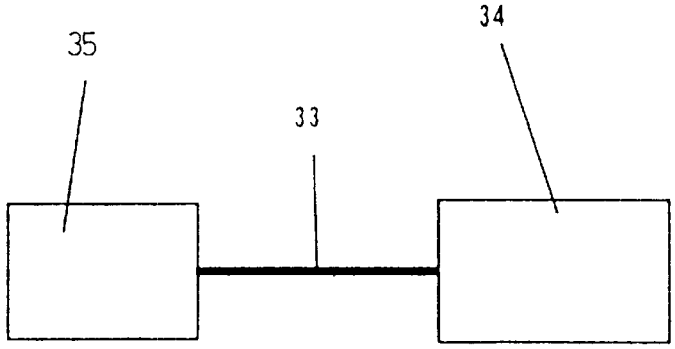
FIG. 21 is a diagram showing the structure of the system including the radio device of the eighth preferred embodiment of the present invention.

FIG. 21 shows the system structure of the radio device in the eighth embodiment of the present invention. FIG. 21 illustrates a radio device 35, a signal transmission cable 33, and a control unit 34. The radio device 35 and the control unit 34 exchange signals via the signal transmission cable 33. The control unit 34 performs signal processing, and the radio device 35 radiates and receives radio waves. Although the control unit 34 is connected to only one radio device 35 in FIG. 21, it is generally connected to plural radio devices.

Figure 22:
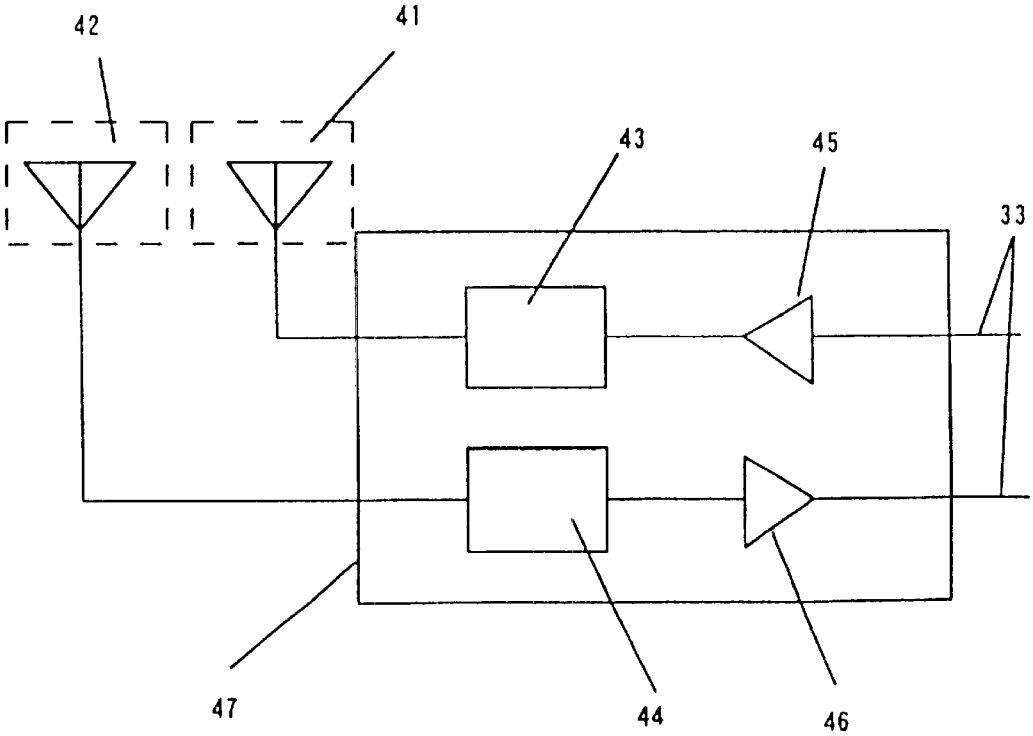
FIG. 22 is a block diagram showing a radio device of the eighth embodiment.
Figure 23:
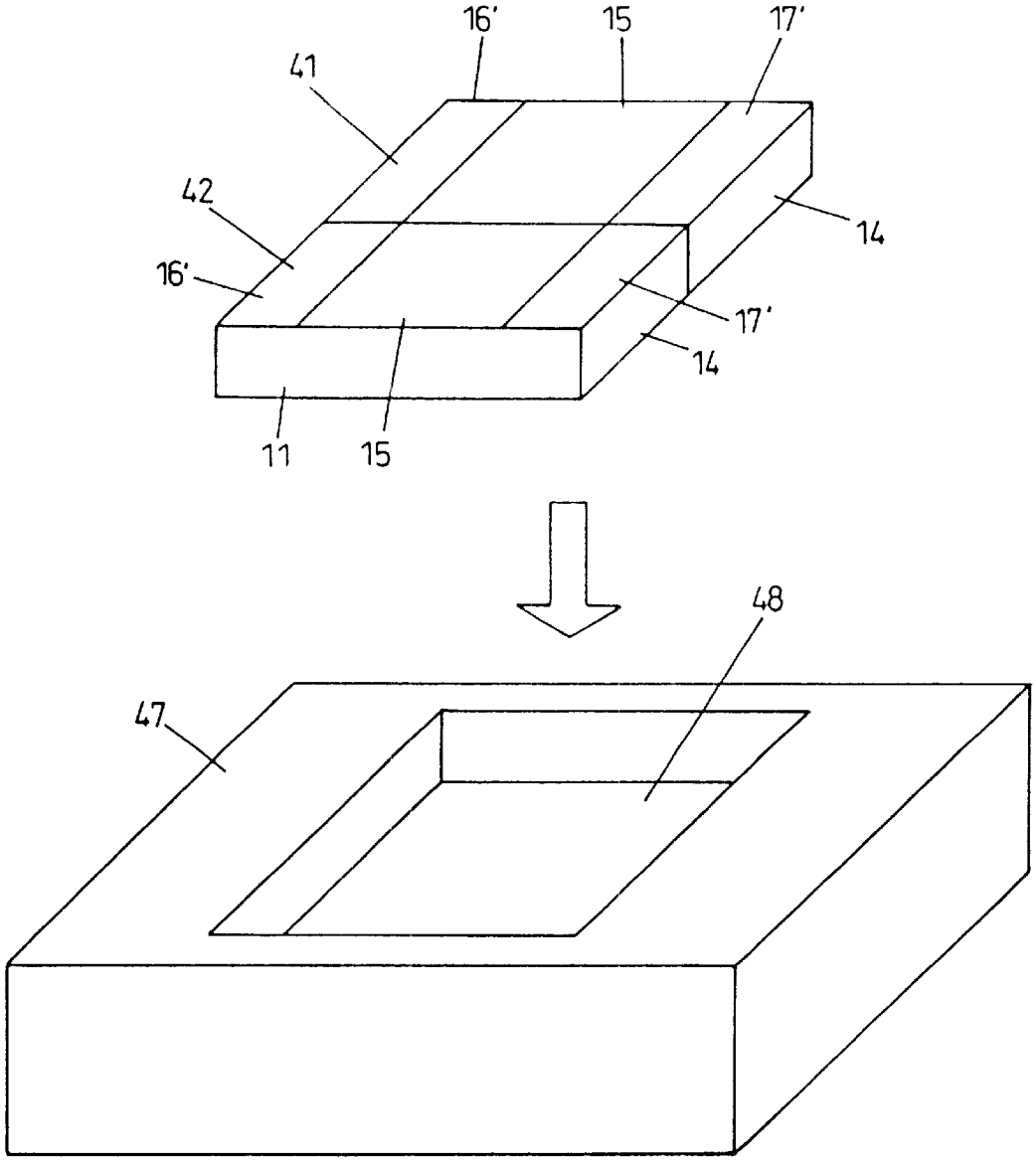
FIG. 23 is an exploded perspective diagram showing the radio device of the eighth embodiment.

FIGS. 22 and 23 show the structure of the radio device in the eighth embodiment. These figures illustrate a signal transmission cable 33, antennas 41 and 42, filters 43 and 44 as an example of frequency selection means, amplification circuits 45 and 46, a cabinet 47, and a concave portion 48. The filters 43 and 44 and the amplification circuits 45 and 46 are arranged inside the cabinet 47. The concave portion 48 is formed on the surface of the cabinet 47, and the antenna 41 and 42 are imbedded in the concave portion 48 as shown in FIG. 23. The antennas 41 and 42 are those described in the first through seventh embodiments. The signal transmission cable 33 is made of an electric signal transmission cable such as a coaxial cable.

The behavior of the system will be described as follows.

In FIG. 21, the circuit system for supplying signals from the control unit 34 to the radio device and transmitting radio waves from the antenna 41 of the radio device is referred to as a down system. The circuit system for receiving radio waves from the antenna 42 of the radio device and sending signals to the control unit 34 is referred to as an up system. Figure 22 shows a structural example of the radio device. In the down system, the power supply unit of the antenna 41 is connected to the filter 43 which is connected to the amplification circuit 45. In the up system, the power supply unit of the antenna 42 is connected to the filter 44, which is connected to the amplification circuit 46.

As for the flow of signals, in the down system, the signals processed in the control unit 34 are sent to the amplification circuit 45 in the radio device via the electric signal transmission cable 33 and amplified by the amplification circuit 45. After this, the signals corresponding to the usable frequency band are exclusively sent from the filter 43 to the antenna 41 due to its passage band limitations and radiated out as radio waves from the antenna 41 into space.

In the up system, on the other hand, the signals received from the antenna 42 are sent to the filter 44. The signals corresponding to the usable frequency band are exclusively sent to the amplification circuit 46 due to the passage band limitations of the filter 44, and amplified by the amplification circuit 46. After this, they are sent to the control unit 34 via the electric signal transmission cable 33.

In the monopole antennas described in the first through seventh embodiments, the openings 16 and 17 for radiating waves are arranged on the antenna ceiling portion, and the antenna element 13 as a radiation source is surrounded by the ground conductor 11 and the side conductor 14, so that the radiation waves are not strongly affected by the antenna arrangement environment in the antenna side and bottom directions. When the radio device 35 is installed in a room where it is difficult to imbed the cabinet 47, the antennas (the monopole antennas of the first through seventh embodiments) are imbedded in the concave portion 48. This eliminates the projection from the cabinet 47, making the antenna inconspicuous. As a result, the environmental appearance is less spoiled by the radio device.

Figure 24:
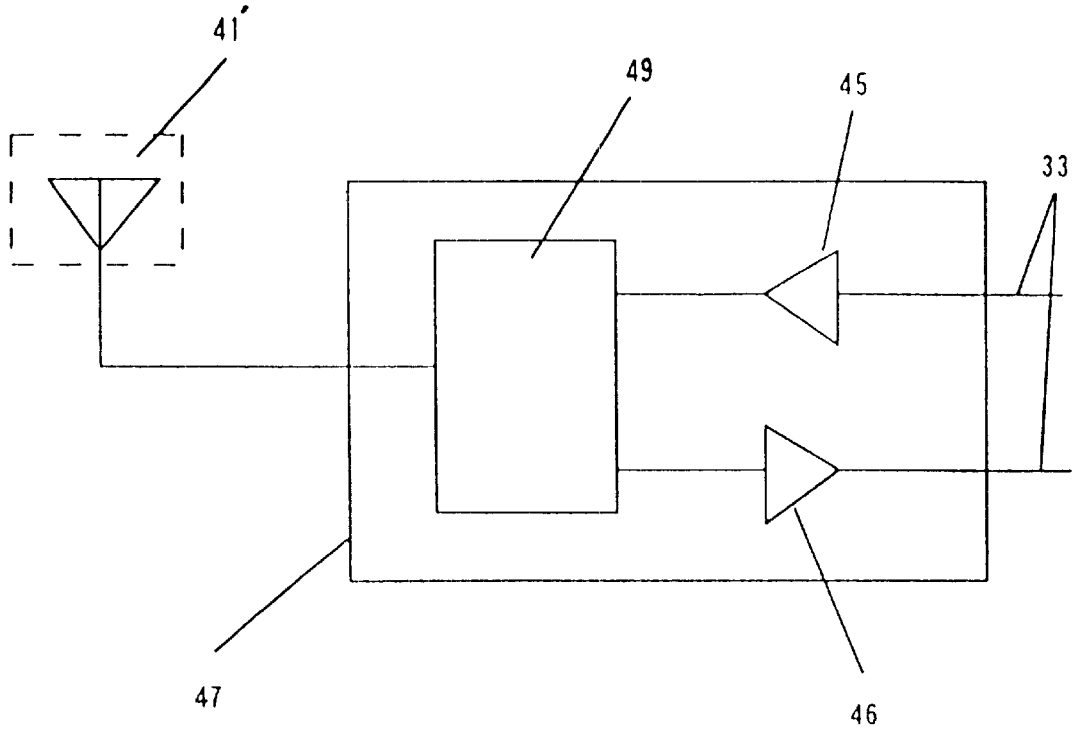
FIG. 24 is a block diagram showing another radio device of the eighth embodiment.

Although the radio device of the eighth embodiment comprises the two antennas 41 and 42 of the up and down systems and two filters 43 and 44, the present invention is not restricted to this structure. For example, it is also possible to employ the antenna 41' which operates in both an up system usable frequency band and a down system usable frequency band, and a shared device 49 as shown in FIG. 24. The use of one antenna 41' and one filter (shared device 49) reduces the radio device in size.

Figure 25:
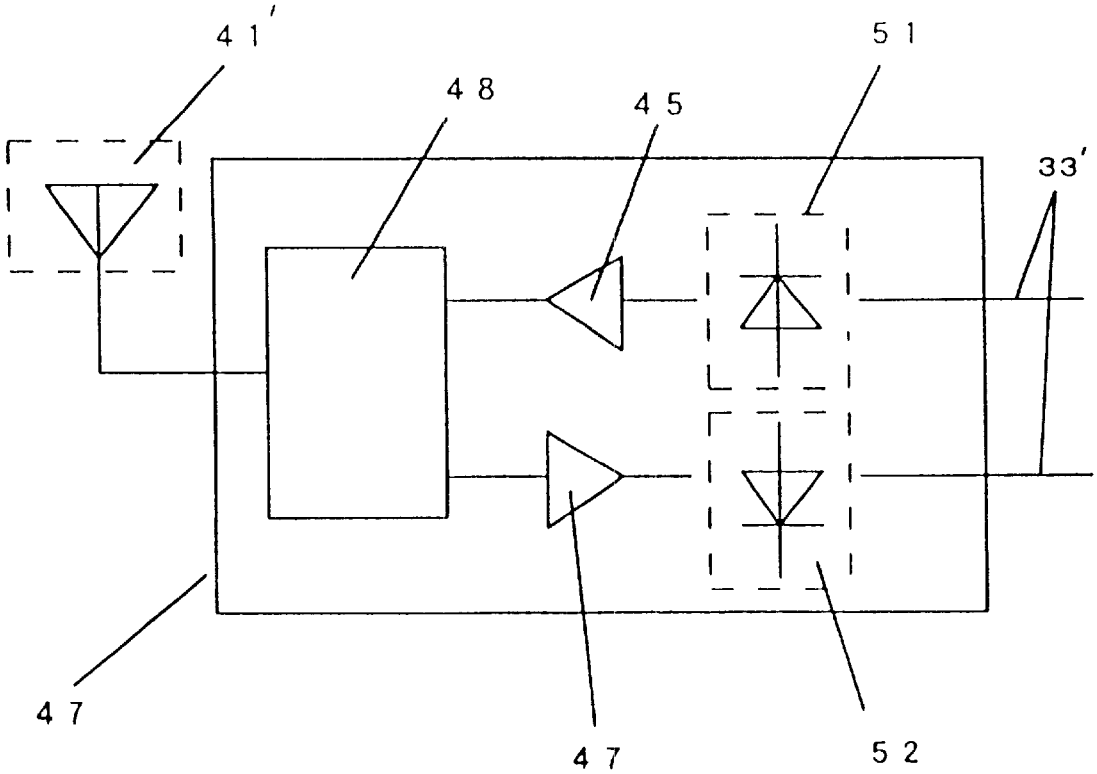
FIG. 25 is a block diagram showing further another radio device of the eighth embodiment.

The eighth embodiment employs an electric signal transmission cable as the signal transmission cable 33; however, the present invention is not restricted to this structure. For example, FIG. 25 shows the signal transmission cable made of an optical signal transmission cable 33' such as an optical fiber. Besides the shared device 48 used in FIG. 25, a pair of filters 43 and 44 shown in FIG. 22 can be used, which requires to convert electric signals into optical signals for transmission. Consequently, as shown in FIG. 25 it is required to provide a photo diode 51 for converting optical signals into electric signals between the optical signal transmission cable 33' and the amplification circuit 45 in the down system, and a laser 52 for converting electric signals into optical signals between the amplification circuit 47 and the optical signal transmission cable 33' in the up system. In the control unit 34, a photo diode (not shown) is required for the connection with the optical signal transmission cable 33' in the up system and a laser (not shown) is required for the connection with the optical signal transmission cable 33' in the down system. Such a structure reduces the cost to install the optical signal transmission cable 33' or attenuation of signals due to the transmission length of the cable 33', thereby realizing a long distance signal transmission. Furthermore, the use of optical signals having different wavelengths for the up and down systems to perform wavelength multiplexing makes it possible to compose the optical signal transmission cable 50 with a single optical fiber. This structure requires to provide an optical coupler 60 between the optical signal transmission cable 33' and the laser 52 and between the cable 33' and the photo diode 51.

Figure 26:
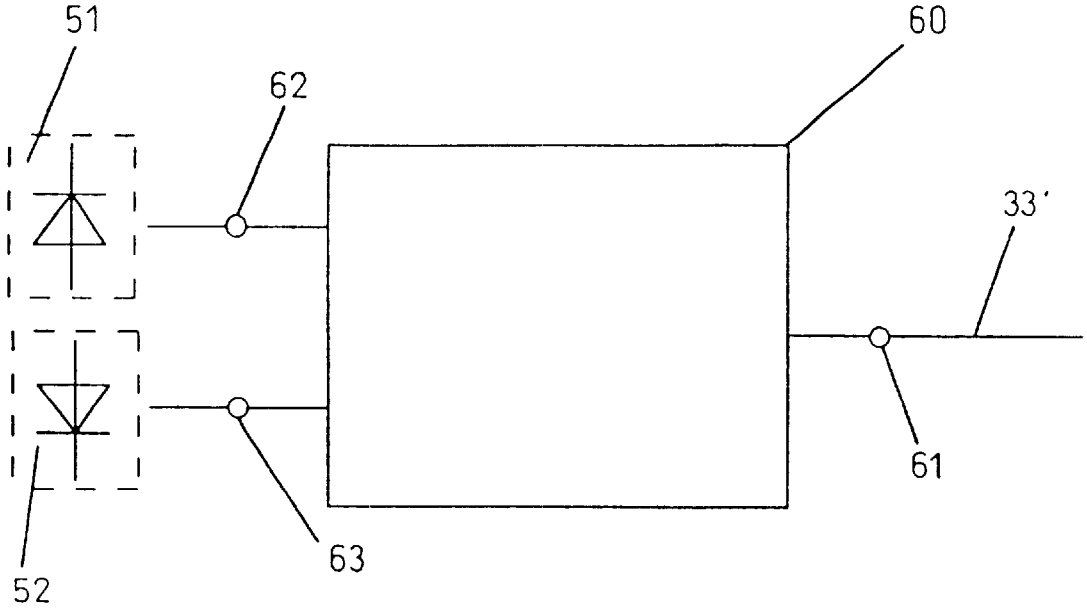
FIG. 26 is a block diagram showing the structure of an optical coupler installed in the radio device of the eighth embodiment.

As shown in FIG. 26 the optical coupler 60 comprises three terminals 61, 62, and 63, which are connected to the optical signal transmission cable 33', the photo diode 51, and the laser 52, respectively. The provision of the optical coupler 60 makes optical signals of the up and down systems be transmitted as follows. Down system transmission signals received by the antennas 41 and 41' are converted into optical signals by the laser 52, and sent to the optical signal transmission cable 33' via the optical coupler 60. Up system transmission signals, on the other hand, are sent via the optical coupler 60 from the cable 33' to the photo diode 51 where they are converted into electric signals so as to be sent to the antennas 42 and 41'. This structure requires only one optical signal transmission cable, thereby reducing the cost of the cable itself required for transmission and also the cost to install it.

Each of the above-mentioned embodiments can be modified variously as follows.

(1) Although the monopole antennas of the first through seventh embodiments are symmetric with respect to the ZY plane and the ZX plane, the present invention is not restricted to this structure. In order to achieve desired radiation directivity or input impedance characteristics, an antenna can be designed to be symmetric with respect to the ZY plane only, or asymmetric with respect to the ZY plane and ZX plane. In addition, only the openings 16 and 17 can be symmetric with respect to the ZY plane only or to both the ZY and ZX planes. Only the ground conductor 11 can be symmetric with respect to the ZY plane only or to both the ZY and ZX planes. Only the ceiling conductor 15 can be symmetric with respect to the ZY plane only or to both the ZY and ZX planes. Only the side conductor 14 can be symmetric with respect to the ZY plane only, or to both the ZY and ZX planes. Alternatively, a combination of these can be possible to achieve an antenna having radiation directivity best suitable for the radiation target space.

(2) In the monopole antennas of the first through seventh embodiments, the ground conductor 11, the side conductor 14, and the ceiling conductor 15 are electrically connected to each other; however the present invention is not restricted to this structure. For example, in order to achieve desired radiation directivity or input impedance characteristics, the ceiling conductor 15 and the side conductor 14 can be electrically separated; the ground conductor 11 and the side conductor 14 can be electrically separated; or all of these conductors 11, 14, and 15 can be electrically separated.

(3) Although the monopole antennas of the first through seventh embodiments have two openings 16 and 17, the present invention is not restricted to this structure. For example, in order to achieve desired radiation directivity or input impedance characteristics, one or more than two openings can be provided.

(4) In the monopole antennas of the first through seventh embodiments, the openings 16 and 17 are rectangles; however, the present invention is not restricted to this structure. For example, in order to achieve desired radiation directivity or input impedance characteristics, the openings 16 and 17 can be circles, squares, polygons, semicircles, a combination of these shapes, rings, or other shapes. When the openings 16 and 17 are circular, oval, or any shapes with a curve, the corner formed in the conductive portion constituting the antenna becomes round in the radiation directivity. As a result, the corner has less diffraction effects, which desirably reduces the cross-polarized conversion loss of the radiation waves.

(5) In the monopole antennas of the first through seventh embodiments, two openings 16 and 17 are arranged on the antenna ceiling portion; however, the present invention is not restricted to this structure. For example, in order to achieve desired radiation directivity or input impedance characteristics, the openings 16 and 17 can be arranged on the side conductor 14 or on the ground conductor 11. Or these structures can be combined.

(6) In the monopole antennas of the first through seventh embodiments, the ground conductor 11 is a square; however, the present invention is not restricted to this structure. For example, in order to achieve desired radiation directivity or input impedance characteristics, the ground conductor 11 can be any other polygon, a semicircle, or a combination thereof, or other shapes.

The ground conductor 11 can be circular, oval, or any shape with a curve. In these cases, the corner of the conductive portion constituting the antenna becomes round in the radiation directivity, and as a result, the corner has less diffraction effects, which desirably reduces the cross-polarized conversion loss of the radiation waves.

(7) In the monopole antennas of the first through seventh embodiments, the ceiling conductor 15 is a square; however, the present invention is not restricted to this structure. For example, in order to achieve desired radiation directivity or input impedance characteristics, the ceiling conductor 15 can be any other polygon, a semicircle, or a combination thereof, or other shapes, further can be circular, oval, or any shape with a curve. In these cases, the corner of the conductive portion constituting the antenna becomes round in the radiation directivity, and as a result, the corner has less diffraction effects, which desirably reduces the cross-polarized conversion loss of the radiation waves. Furthermore, when the entire structure of the monopole antenna is shaped like as disk, the following advantage can be obtained. Since the installment environment of the monopole antenna varies widely, there are cases that the designed radiation directivity cannot be actually exerted. In that case, the direction to install the antenna is adjusted in the horizontal direction. In contrast, desired radiation directivity is generally so designed as to be exerted under the conditions that the four sides of the monopole antenna are equal to the fundamental direction (the plane direction of a side wall in a room) regulated in the installment environment. For this reason, a minor adjustment of the installment direction may put the four side directions of the antenna out of the fundamental direction, causing the antenna to be installed in an undesired manner from the view point of appearance. On the other hand, when the monopole antenna is designed to be circular, there is no fixed direction in the side of the monopole antenna, so that the side direction of the antenna never be out of the fundamental direction by a minor adjustment of the installment direction.

(8) In the monopole antennas of the first through seventh embodiments, the side conductor 14 is perpendicular to the ground conductor 11; however, the present invention is not restricted to this structure. For example, in order to achieve desired radiation directivity or input impedance characteristics, the side conductor 14 can be orthogonal to the ground conductor 11.

(9) In the monopole antennas of the first through seventh embodiments, the side conductor 14 is provided on the frame formed along the outline of the ground conductor 11; in other words, the frame formed by the side conductor 14 is approximately equal to the ground conductor 11 in size. However, the present invention is not restricted to this structure. For example, in order to achieve. desired radiation directivity or input impedance characteristics, the frame formed by the side conductor 14 can be larger or smaller than the ground conductor 11. Or the frame can be larger or smaller than the ceiling conductor 15.

Figure 27:
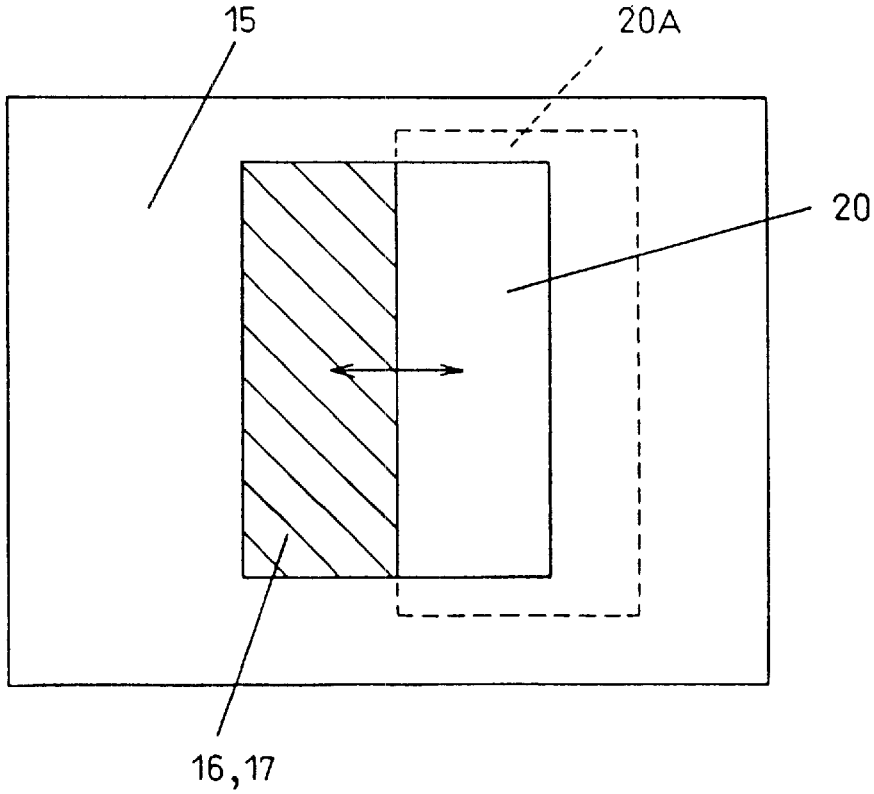
FIG. 27 is a diagram showing an opening control device installed in each embodiment of the present invention.

(10) In the monopole antennas of the first through seventh embodiments, the openings 16 and 17 have a fixed size; however, the present invention is not restricted to this structure. For example, as shown in FIG. 27, the openings 16 and 17 can be provided with an opening adjustment device 20 which can change the size of the openings 16 and 17. The opening adjustment device 20 can be realized by providing a sliding conductive plate 20*a* for changing the size of the openings 16 and 17 along them. Changing the size of the openings 16 and 17 as desired by means of the opening adjustment device 20 makes it possible to obtain desired radiation directivity.

(11) In the monopole antennas of the first through seventh embodiments, the antenna element 13 is made of a linear conductor; however, it can be a different antenna element. For example, it can be a helical type monopole antenna element made of a coiled conductive wire, or a reverse L type or a reverse F type monopole antenna by folding the conductive wire in the form of letter L or F. It also can be a top loading type monopole antenna element having a capacitive load such as a conductive plate at the tip of a conductive wire. Alternatively, these can be combined to form a different antenna element. These structures make the antenna element small and low-profile, and the antenna as a whole becomes small and low-profile.

(12) The monopole antennas. of the first through seventh embodiments each comprise the ground conductor 11, the ceiling conductor 15, the side conductor 14, the antenna element 13, the coaxial power supply part 12, and the openings 16 and 17; however, the present invention is not restricted to this structure. For example, in order to achieve desired radiation directivity or input impedance characteristics, the antenna ceiling portion can be entirely open without the ceiling conductor 15. According to this structure, when the antenna is symmetric with respect to the ZY plane and the ZX plane, the directivity of the vertical plane can be changed to obtain approximately nondirectional characteristics on the horizontal plane of the antenna. Alternatively, it is possible to provide the openings 16 and 17 on the ground conductor 11 and the side conductor 14. In this case, in order to achieve desired radiation directivity or input impedance characteristics, the antenna can be symmetric with respect to the ZY plane and the ZX plane, only to the ZX plane, or asymmetric with respect to these planes. Only the openings 16 and 17 can be symmetric with respect to the ZY plane, or to both the ZY and ZX planes. Only the ground conductor 11 can be symmetric with respect to the ZY plane, or to both the ZY and ZX planes. Only the side conductor 14 can be symmetric with respect to the ZY plane, or to both the ZY and ZX planes. Also a combination of these features can be possible. All these structures can achieve an antenna having radio directivity best suitable for radiation target space.

(13) The monopole antennas of the first through seventh embodiments can be arranged in an array so as to constitute a phased array antenna and an adaptive antenna array. Consequently, the control of the directivity of radio waves is facilitated.

Figure 28A:
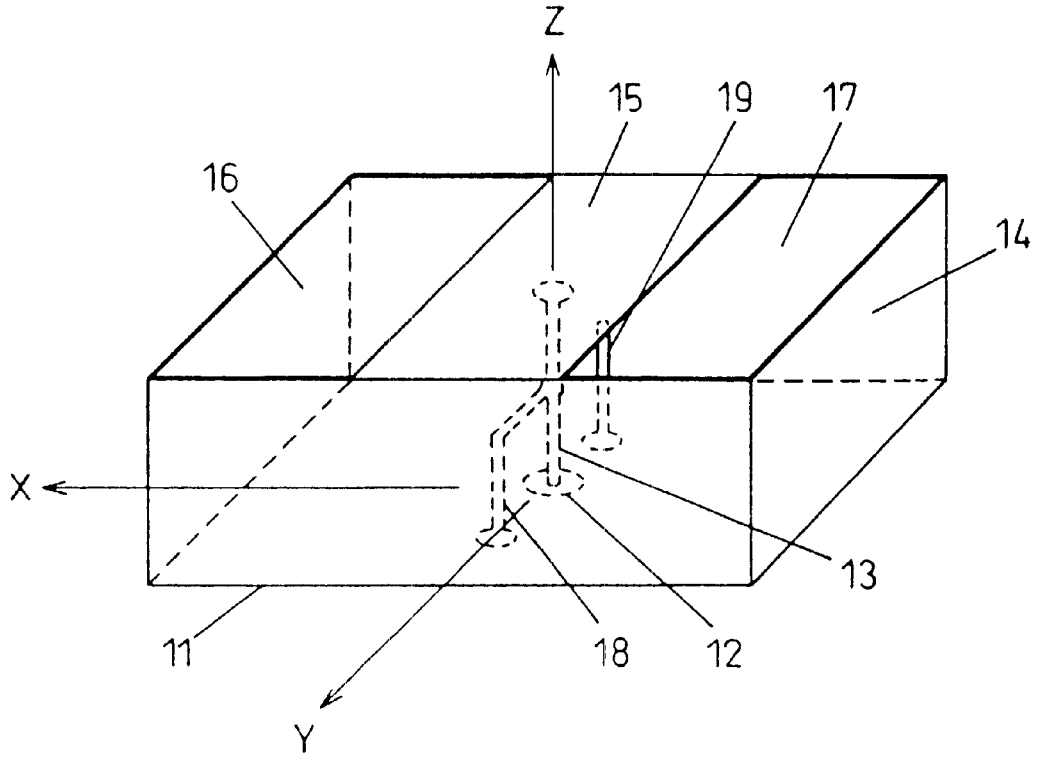
FIG. 28A is a rough perspective view of a modified example of the present invention.
Figure 28B:
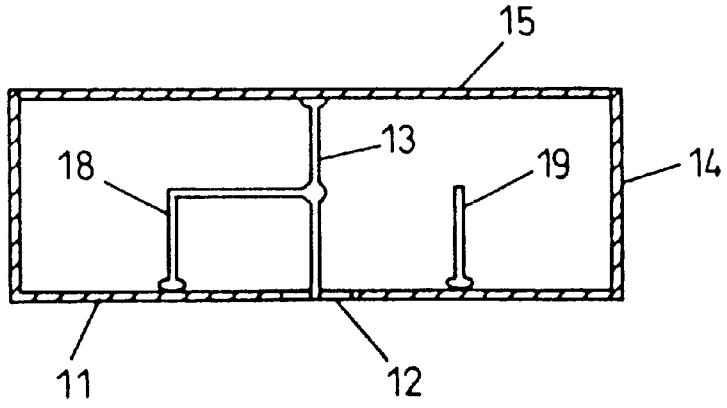
FIG. 28B is a sectional view of FIG. 28A.

(14) The third embodiment shows the structure where the antenna element 13 is electrically separated from the ceiling conductor 15; however, the present invention shown in the third embodiment is not restricted to this structure. For example, as shown in FIGS. 28A and 28B, one end of the antenna element 13 can be electrically connected to the ceiling conductor 15. In this case, the antenna element 13 is not necessarily a linear conductor but can be a helical type monopole antenna element made of a coiled conductive wire or the like. This makes the antenna element 13 small and low-profile, thereby making the antenna as a whole small and low-profile.

(15) The monopole antenna in the third embodiment has two matching conductors 18 and 19; however, the present invention is not restricted to this structure. For example, one or more than two openings can be provided. This structure increases the flexibility of the antenna structure, thereby further enhancing the matching conditions with the coaxial power supply part 12.

(16) The monopole antenna in the third embodiment has two matching conductors 18 and 19 arranged away from the antenna element 13 in the ZY plane; however, the present invention is not restricted to this structure. For example, the matching conductors 18 and 19 can be arranged at any position parallel to the Z axis. This structure increases the flexibility of the antenna structure, thereby further enhancing the matching conditions with the coaxial power supply part 12.

(17) The monopole antenna in the third embodiment has the matching conductors 18 and 19 made of a linear conductor; however, they can be made of a conductor having other shapes. For example, they can be helical type matching conductors made of a coiled conductive wire, or can be made of a conductive wire folded in the form of letter L. This makes the matching conductors small and low-profile, thereby making the antenna as a whole small and low-profile.

Figure 29A:
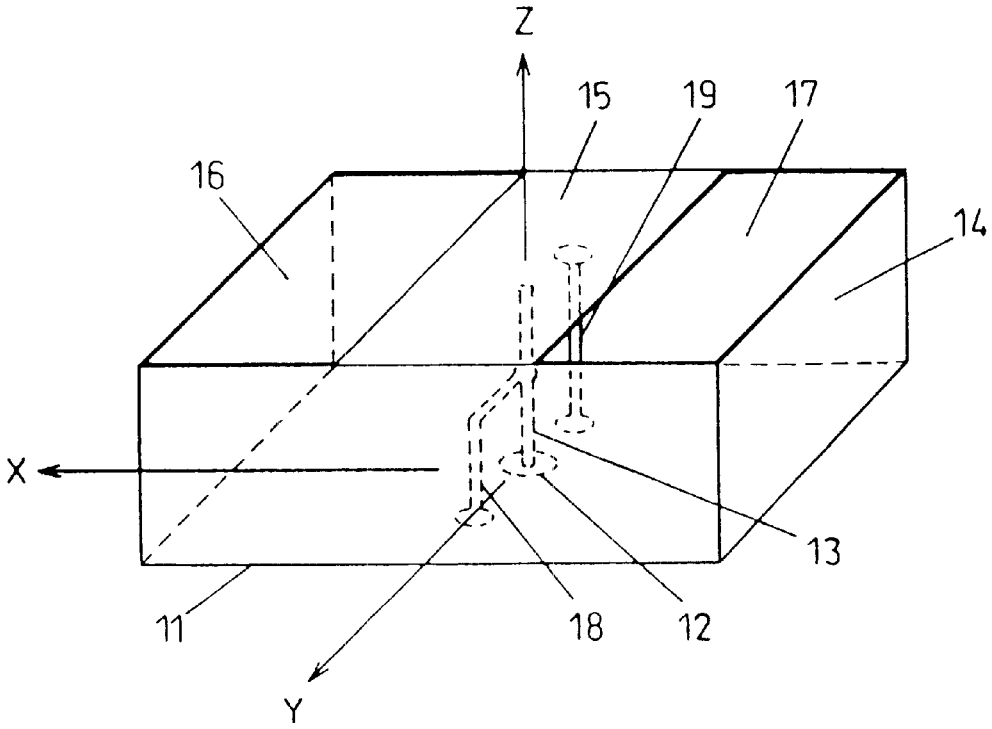
FIG. 29A is a rough perspective view of another modified example of the present invention.
Figure 29B:
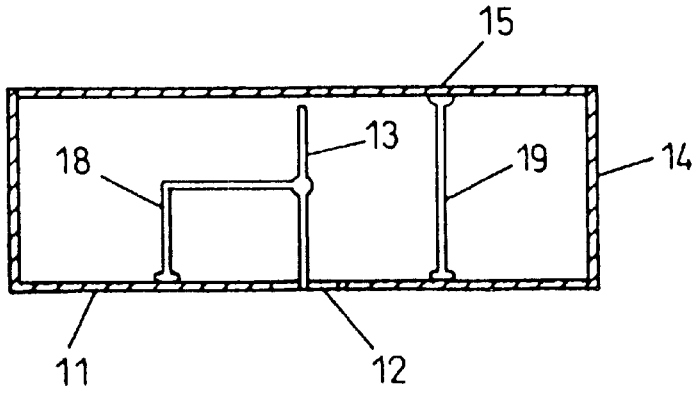
FIG. 29B is a sectional view of FIG. 29A.

(18) The monopole antenna in the third embodiment has the matching conductors 18 and 19 arranged away from the antenna element 13; however, the present invention is not restricted to this structure. For example, as shown in FIGS. 29A and 29B, one end of either or both of the matching conductors 18 and 19 can be electrically connected to one end or in the middle of the antenna element 13. This structure enhances the impedance of the monopole antenna, thereby improving the matching conditions between the monopole antenna and the coaxial power supply part 12 when the impedance is low.

(19) The monopole antenna in the third embodiment has the matching conductors 18 and 19 arranged away from the ceiling conductor 15; however, the present invention is not restricted to this structure. For example, as shown in FIGS. 29A and 29B, one end of either or both of the matching conductors 18 and 19 can be electrically connected to the ceiling conductor 15. This structure can change the impedance of the monopole antenna, thereby improving the matching conditions between the monopole antenna and the coaxial power supply part 12.

Figure 30:
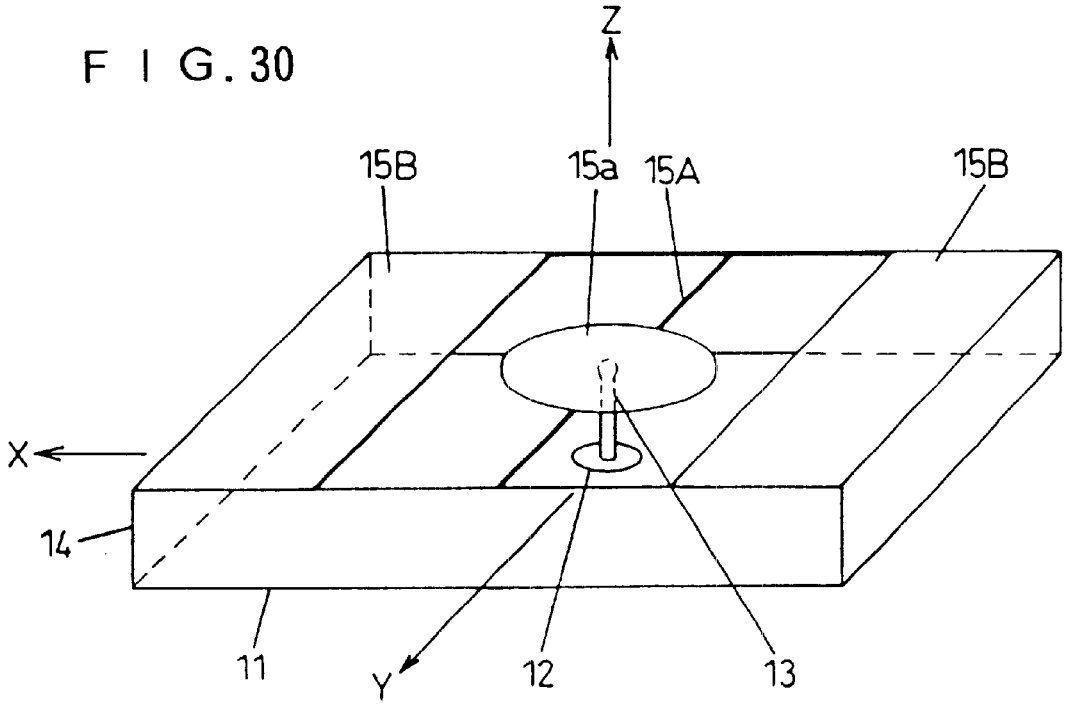
FIG. 30 is a rough perspective view of further another modified example of the present invention.
Figure 31:
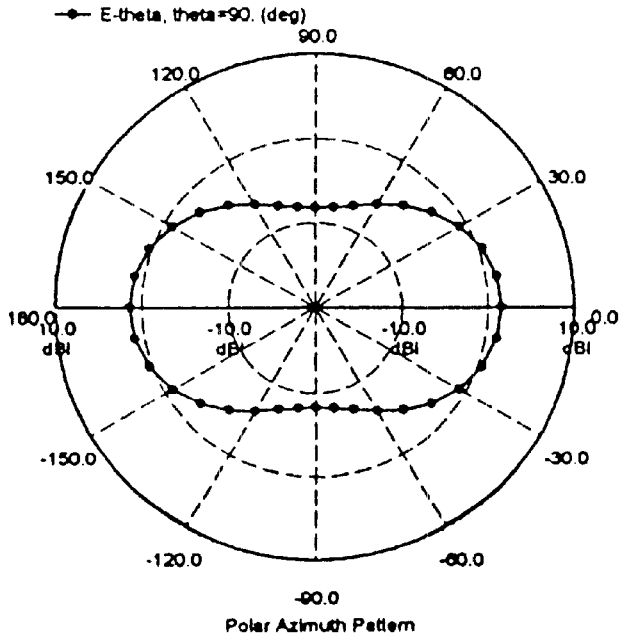
FIG. 31 is a diagram showing the radio directivity of the modified example of FIG. 30.

(20) In the first through seventh embodiments, both ends of the ceiling conductor 15 are electrically connected to the side conductor 14, which undesirably produces a minimum point in the radiation directivity of the horizontal plane along the line extending between both ends of the ceiling conductor 15. This results from the fact that the current leakage caused from the connection point of the ceiling conductor 15 and the side conductor 14 makes it almost impossible to transmit radio waves in that direction. When such a point needs to be eliminated, the antenna should be designed to have a circular portion 15*a* on the ceiling conductor 15 as shown in FIG. 30. The circular portion 15*a* is provided in the center of the line extending between both ends of the ceiling conductor 15. Since the circular portion 15*a* receives radio waves from the entire circumference, it can radiate waves under almost nondirectional conditions along the horizontal plane. Therefore, the ceiling conductor 15 as a whole radiates a mixture of radio waves having the minimum point and radio waves nondirectional to the horizontal plane. This allows radio waves to be radiated on the minimum point, thereby forming oval radiation directivity along the horizontal plane, as shown in FIG. 31. The amount of wave radiation at the minimum point can be adjusted by changing the size of the circular portion 15*a*.

Figure 32:
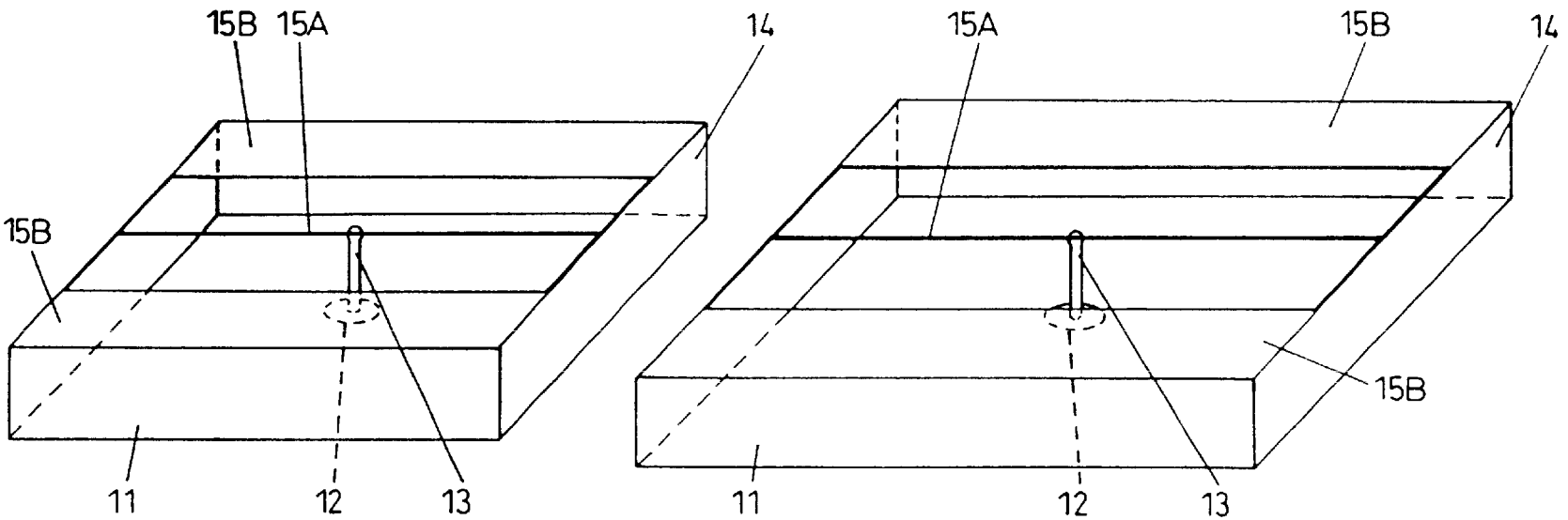
FIG. 32 is a perspective view showing an arrangement of the monopole antenna of the present invention.

(21) When the monopole antennas of the first through seventh embodiments perform radio wave transmission, plural (for example, two) monopole antennas are arranged in parallel. In this case, the isolation between adjacent antennas must be secured. It is usually done by providing isolation elements such as filters, but can be facilitated as follows. In the monopole antennas, in those of the present invention in particular, the directivity of the horizontal plane has the minimum point, which is formed in the direction of the connection point of the ceiling conductor 15 and the side conductor 14. Adjacent monopole antennas are aligned so as to make the direction to form the minimum points on the same line. This arrangement minimizes the influences of the radio waves transmitted between the monopole antennas, thereby facilitating to secure isolation. For example, in the monopole antenna shown in FIG. 7, both ends of the ceiling conductor 15 in the longitudinal direction are electrically connected to the side conductor 14, so that the longitudinal direction of the ceiling conductor 15 becomes the direction to form the minimum point of radio waves. As shown in FIG. 32, adjacent monopole antennas are arranged so as to make the longitudinal direction of each of the ceiling conductors 15 on the same line. This arrangement minimizes the influences of the radio waves transmitted between the monopole antennas, thereby facilitating to secure isolation.

Figure 33:
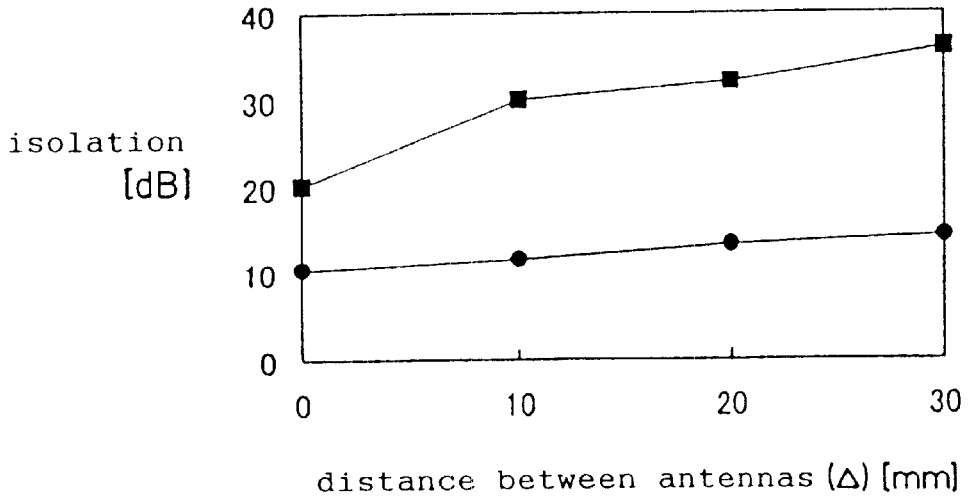
FIG. 33 is a graph showing the measurement results of isolation in the arrangement of FIG. 32.

Isolation was measured when the monopole antennas are arranged as above (hereinafter referred to as influence exclusion arrangement). Similarly, isolation was measured when adjacent monopole antennas are arranged in the direction perpendicular to the longitudinal direction of the ceiling conductors 15 (hereinafter referred to as influence non-exclusion arrangement). These measurement results are shown in FIG. 33 where the line with black squares indicates the measurement results of the influence exclusion arrangement and the line with black circles indicates the measurement results of the influence non-exclusion arrangement. The horizontal axis indicates the intervals (mm) between adjacent monopole antennas and the vertical axis indicates the measurement results of isolation (dB).

The graph of FIG. 33 reveals that the influence exclusion arrangement is superior in isolation. Since isolation can be secured easier in the influence exclusion arrangement, sufficient isolation can be obtained when low-performing isolation elements (filters) are employed. As a result, the production cost can be reduced.

When plural monopole antennas are used, they are arranged on a metallic base plate in order to reinforce the structure; however, in that case, the ground conductors 11 are short-circuited by the metallic base plate, deteriorating the isolation even with the influence exclusion arrangement. For this reason, it is better not to use a metallic base.

Figure 34:
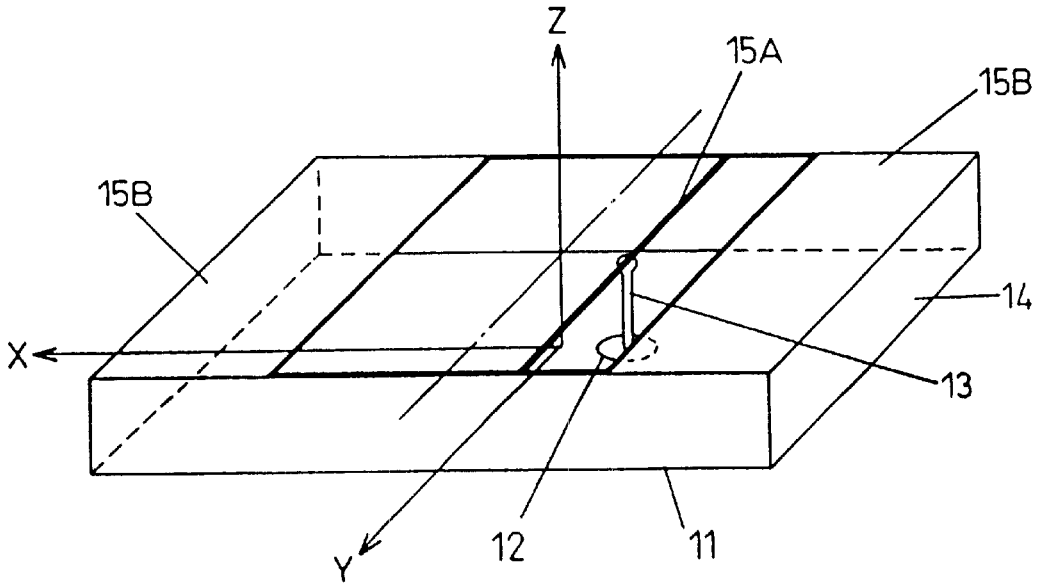
FIG. 34 is a rough perspective view of further another modified example of the present invention.
Figure 35:
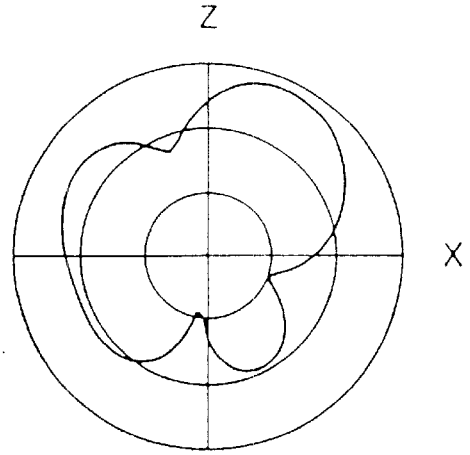
FIG. 35 is a diagram showing the radio directivity of the modified example of FIG. 34.
Figure 36:
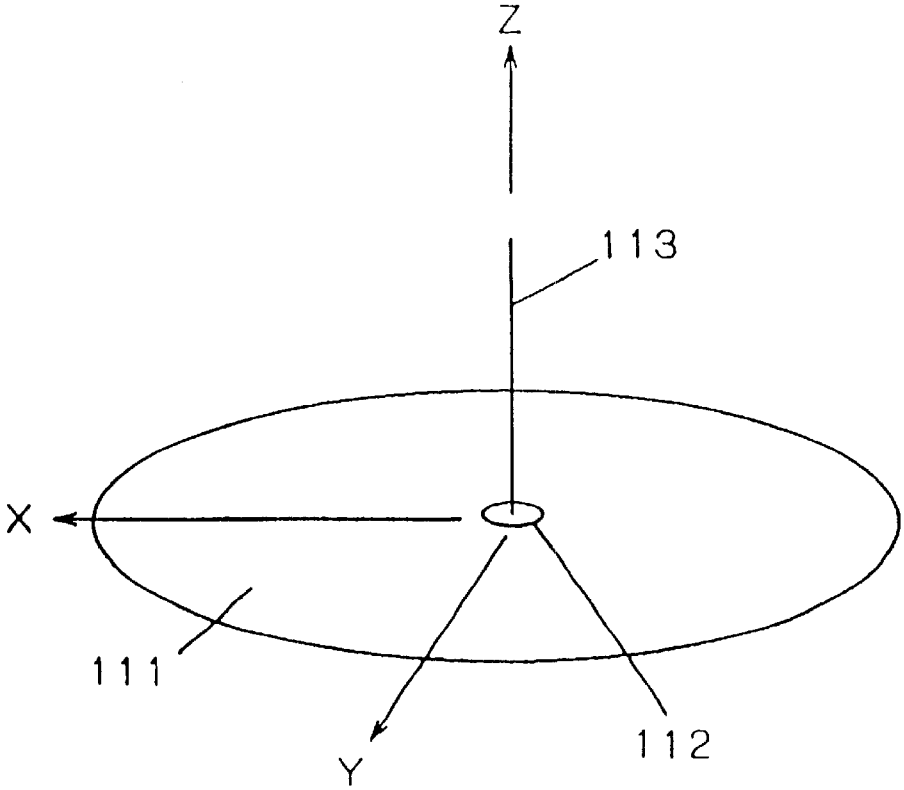
F I G. 36 PRIOR ART
FIG. 36 is a rough perspective view of a first prior art.

(21) In the first through seventh embodiments, the monopole antennas are symmetric with respect to the ZX plane and the ZY plane, and the coaxial power supply part 12 is arranged in the origin point so as to make the radiation directivity along the horizontal plane nondirectional. However, the present invention is not restricted to this structure; the coaxial power supply part 12 can be arranged out of the origin point in the direction of the horizontal plane, so as to adjust the directivity of radio waves along the horizontal plane. For example, as shown in FIG. 34, if the coaxial power supply part 12 is slightly shifted in the + direction along the X axis, the directivity along the horizontal plane becomes as shown in FIGS. 35A and 35B. Thus the directivity along the ZX plane is not symmetric with respect to the ZY plane, and becomes symmetric with respect to the slightly diagonal direction which connects the upper left and lower light quadrants.

Although the aforementioned description shows the effects of the present invention in sending radio waves, it goes without saying that the same effects can be secured in receiving radio waves.

Although the present invention has been described by way of preferred embodiments, it is to be noted that the combination and arrangement of their components can be changed variously within the scope of the present invention, which will be claimed below.

What is claimed is:

1. A monopole antenna comprising:

a ground conductor;

a power supply part arranged on a surface of said ground conductor;

an antenna element connected to said power supply part;

a side conductor surrounding a space including said antenna element apart from said antenna element, said side conductor contacts said ground conductor; and a ceiling conductor facing said ground conductor with said antenna element therebetween, wherein an edge portion of said ceiling conductor contacts said side conductor and said ceiling conductor has at least one opening for radiating electromagnetic waves, said at least one opening being arranged in number and size in accordance with directivity of said electromagnetic waves to be radiated from said monopole antenna.

2. The monopole antenna according to claim 1, wherein said power supply part is arranged on an origin point, said ground conductor is arranged on an XY plane, said ground conductor and said side conductor are designed to be symmetric with respect to a ZY plane, and said at least one opening is arranged to be symmetric with respect to the ZY plane.

3. The monopole antenna according to claim 2, wherein said ground conductor and said side conductor are designed to be symmetric with respect to a ZX plane, and said at least one opening is arranged to be symmetric with respect to the ZX plane.

4. The monopole antenna according to claim 1, wherein said antenna element is electrically connected to said ceiling conductor.

5. The monopole antenna according to claim 1 further comprising at least one matching element arranged apart from said antenna element, said matching element being electrically connected to said ground conductor.

6. The monopole antenna according to claim 5, wherein at least one said matching element is electrically connected to said antenna element.

7. The monopole antenna according to claim 1, wherein said monopole antenna is arranged and dimensioned so that said antenna emits substantially more energy in a first direction from said antenna than in a second direction from said antenna.

8. The monopole antenna according to claim 7, wherein said first direction is located on a horizontal plane of said antenna.

9. The monopole antenna according to claim 8, wherein said second direction is located perpendicular to said first direction on the horizontal plane of said antenna.

10. The monopole antenna according to claim 7, wherein said monopole antenna is further arranged and dimensioned so that energy emission is substantially eliminated from a third direction from said antenna.

11. The monopole antenna according to claim 10, wherein said third direction is located on a vertical plane of said antenna.

12. The monopole antenna according to claim 1, wherein said monopole antenna is arranged and dimensioned so that energy emission therefrom effects magnetic current sources having opposing directions.

13. A monopole antenna comprising:

a ground conductor;

a power supply part arranged on a surface of said ground conductor;

an antenna element connected to said power supply part;

a side conductor surrounding a space including said antenna element apart from said antenna element; and a ceiling conductor facing said ground conductor with said antenna element therebetween, wherein an edge portion of said ceiling conductor is electrically connected to said side conductor, wherein said ceiling conductor has a circular central portion.

14. A monopole antenna comprising:

a ground conductor;

a power supply part arranged on a surface of said ground conductor;

an antenna element connected to said power supply part;

a side conductor surrounding a space including said antenna element apart from said antenna element; and a ceiling conductor facing said ground conductor with said antenna element therebetween, wherein at least one of said ground conductor, said side conductor, and said ceiling conductor has an opening; said monopole antenna further comprising means for adjusting the size of said opening.

15. A monopole antenna comprising:

a ground conductor;

a power supply part arranged on a surface of said ground conductor;

an antenna element connected to said power supply part;

a side conductor surrounding a space including said antenna element apart from said antenna element; and a ceiling conductor facing said ground conductor with said antenna element therebetween, wherein said ground conductor, side conductor and ceiling conductor operate as a transmitter or receiver of electromagnetic waves, wherein a dielectric member having permittivity higher than air is provided in a space surrounded by said ground conductor and said side conductor.

16. The monopole antenna according to claim 15, wherein said space is filled with said dielectric member.

17. The monopole antenna according to claim 15, wherein said dielectric member is structured as a lid for the space surrounded by said side conductor, and one of said ground conductor and said ceiling conductor is provided on said dielectric member.

18. A monopole antenna comprising:

a ground conductor;

a power supply part arranged on a surface of said ground conductor;

an antenna element connected to said power supply part;

a side conductor surrounding a space including said antenna element apart from said antenna element, wherein a dielectric member having permittivity higher than air is provided in a space surrounded by said ground conductor and said side conductor, wherein said side conductor is made of a via hole formed in said dielectric member.

19. A monopole antenna comprising:

a ground conductor;

a power supply part arranged on a surface of said ground conductor;

an antenna element connected to said power supply part;

a side conductor surrounding a space including said antenna element apart from said antenna element;

a ceiling conductor facing said ground conductor with said antenna element therebetween; and at least one matching element arranged apart from said antenna element, said matching element being electrically connected to said ground conductor, wherein at least one said matching element is electrically connected to and contacts said ceiling conductor.

20. A radio device comprising:

a monopole antenna;

amplification means for amplifying transmission signals supplied to said monopole antenna and reception signals supplied from said monopole antenna;

frequency selection means for selecting frequencies of the transmission signals and reception signals; and a cabinet for storing said monopole antenna, said amplification means, and said frequency selection means, wherein said monopole antenna comprises:

a ground conductor, a power supply part arranged on a surface of said ground conductor; an antenna element connected to said power supply part; a side conductor surrounding a space including said antenna element, apart from said antenna element; a ceiling conductor facing said ground conductor with said antenna element therebetween; a dielectric member having permittivity higher than air provided in a space surrounded by said ground conductor and said side conductor; and an opening provided in at least one of said ground conductor, said side conductor, and said ceiling conductor, and said cabinet is provided with a concave portion on a surface thereof for storing said monopole antenna inside.

21. An arrangement structure of a monopole antenna comprising:

a plurality of monopole antennas each comprising a ground conductor, a power supply part arranged on a surface of said ground conductor; an antenna element connected to said power supply part; a side conductor surrounding a space including said antenna element, apart from said antenna element; and a ceiling conductor facing said ground conductor with said antenna element therebetween, wherein said monopole antennas are arranged in a manner to conform the direction for minimizing the directivity of the horizontal plane of each of said monopole antennas.

22. A monopole antenna comprising:

a ground conductor;

a power supply part arranged on a surface of said ground conductor;

an antenna element connected to said power supply part;

a side conductor surrounding a space including said antenna element apart from said antenna element, said side conductor contacts said ground conductor;

a ceiling conductor facing said ground conductor with said antenna element therebetween, wherein an edge portion of said ceiling conductor contacts said side conductor and said ceiling conductor has at least one opening for radiating electromagnetic waves, said at least one opening being arranged in number and size in accordance with directivity of said electromagnetic waves to be radiated from said monopole antenna; and at least one matching element arranged apart from said antenna element, said matching element being electrically connected to said ground conductor.

* * * * *